US009067441B2

(12) United States Patent
Tanaka

(10) Patent No.: US 9,067,441 B2
(45) Date of Patent: Jun. 30, 2015

(54) MEDIUM CARTRIDGE AND PRINTER

(71) Applicant: Brother Kogyo Kabushiki Kaisha, Nagoya-shi, Aichi-ken (JP)

(72) Inventor: Mitsugi Tanaka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/501,113

(22) Filed: Sep. 30, 2014

(65) Prior Publication Data

US 2015/0116441 A1 Apr. 30, 2015

(30) Foreign Application Priority Data

Oct. 31, 2013 (JP) ..... 2013-226615

(51) Int. Cl.
*B41J 11/00* (2006.01)
*B41J 11/22* (2006.01)

(52) U.S. Cl.
CPC ..... *B41J 11/22* (2013.01)

(58) Field of Classification Search
USPC ..... 347/16, 211, 213–215, 217–219, 222, 347/171, 197, 198; 400/611, 613, 618, 621; 271/3.14, 3.18, 3.2
See application file for complete search history.

(56) References Cited

U.S. PATENT DOCUMENTS

| | | | | |
|---|---|---|---|---|
| 7,079,167 | B2 * | 7/2006 | Hayashi | 347/214 |
| 8,382,389 | B2 * | 2/2013 | Yamaguchi et al. | 347/214 |
| 2011/0043590 | A1 * | 2/2011 | Penzo | 347/217 |

FOREIGN PATENT DOCUMENTS

JP 2013-141749 A 7/2013

* cited by examiner

*Primary Examiner* — Kristal Feggins
(74) *Attorney, Agent, or Firm* — Banner & Wifcoff, Ltd.

(57) ABSTRACT

The disclosure discloses a medium cartridge includes a first record medium roll, a second record medium roll, and a connecting arm. The first record medium roll is stored in a first storage part. The second record medium roll is stored in a second storage part. The connecting arm connects the first record medium roll and the second record medium roll, and comprises first bracket parts and second bracket parts. The first bracket parts sandwich the first record medium roll to hold the first record medium roll. The pair of second bracket parts sandwich the second record medium roll to hold the second record medium roll. The first bracket parts comprises a substantially oval-shaped first guide part capable of entering a first lead-in groove. The second bracket parts comprises a substantially circular-shaped second guide part capable of entering a second lead-in.

9 Claims, 15 Drawing Sheets

MEDIUM CARTRIDGE AND PRINTER

CROSS-REFERENCE TO RELATED APPLICATION

The present application claims priority from Japanese Patent Application No. 2013-226615, which was filed on Oct. 31, 2013, the disclosure of which is incorporated herein by reference in its entirety.

BACKGROUND

1. Field

The present disclosure relates to a medium cartridge comprising a plurality of record medium rolls, and a printer that uses the same.

2. Description of the Related Art

There are already known tape cartridges that comprise a plurality of tape rolls and are mounted to tape processors that perform predetermined processing on the tape and used. According to this tape processor (print label producing apparatus), a guide part (positioning pin) that guides a mounting direction of the tape cartridge (tape cassette) is provided so that the tape cartridge is mounted in a correct posture along the axial direction of the respective rolls by the user when mounted in a predetermined area (cassette mounting part).

Nevertheless, according to the prior art, it is difficult to prevent the user from mistakenly mounting the tape cartridge in an improper posture (in which the guide function by the guide part does not work). As a result, it is difficult to suppress a decrease in the durability of the tape cartridge or apparatus side caused by impact and interference sustained during mounting.

SUMMARY

It is therefore an object of the present disclosure to provide a medium cartridge capable of preventing the user from mistakenly mounting the medium cartridge to the apparatus in an improper posture, and a medium processor that uses the same.

In order to achieve the above-described object, according to the aspect of the present application, there is provided a medium cartridge comprising a first record medium roll that winds a record medium wound around a first axis in a manner that enables feed-out and is configured to be stored in a first storage part of a medium processor, a second record medium roll configured to take up and wind around a second axis at least a part of the record medium fed out from the first record medium roll and fed, and to be stored in a second storage part of the medium processor and used, and a connecting arm that connects the first record medium roll and the second record medium roll, the connecting part comprising a pair of first bracket parts that sandwich the first record medium roll from one side and the other side along the first axis to rotatably hold the first record medium roll, and is provided on one side along a line that connects the first axis and the second axis, and a pair of second bracket parts that sandwich the second record medium roll from one side and the other side along the second axis to rotatably hold the second record medium roll, and is provided on the other side along the line, the first bracket parts comprising a substantially oval-shaped first guide part capable of entering a first lead-in groove provided in the first storage part, and the second bracket parts comprising a substantially circular-shaped second guide part capable of entering a second lead-in groove provided in the second storage part.

The medium cartridge in the present disclosure is mounted to a medium processor such as a printer and used, for example. That is, of the first record medium roll disposed on one connecting-direction side and the second record medium roll disposed on the other connecting-direction side via the connecting arm, the first record medium roll is stored in the first storage part of the medium processor, and the second record medium roll is stored in the second storage part of the medium processor.

In the present disclosure, in order to facilitate this storage operation into the first and second storage parts, the first guide part and the second guide part are provided. That is, the pair of first brackets that rotatably holds the first record medium roll is provided on one connecting-direction side of the connecting arm, and the first guide part included in the first brackets guides the storage of the first record medium roll into the first storage part. Further, the pair of second brackets that rotatably holds the second record medium roll is provided on the other connecting-direction side of the connecting arm, and the second guide part included in the second brackets guides the storage of the second record medium roll into the second storage part.

At this time, the second guide part comprises a substantially circular shape. Accordingly, when a groove for permitting entry of the second guide part is provided on the second storage part, for example, easy entry into the groove can be achieved (regardless of the posture of the overall cartridge).

In contrast, the first guide part comprises a substantially oval shape and a long axis. Accordingly, when a groove for permitting entry of the first guide part is provided on the first storage part, the groove is given a shape comprising a parallel line part, for example, making it possible to permit entry of the first guide part into the groove once the cartridge posture is such that the long-axis direction matches the direction of the parallel line part and not during the period in which the long-axis direction does not match the direction of the parallel line part. With this arrangement, it is possible to execute storage of the first record medium roll into the first storage part and storage of the second record medium roll into the second storage part only when the medium cartridge is in a predetermined posture. As a result, it is possible to prevent the user from mounting the medium cartridge to the medium processor in an improper posture, thereby making it possible to suppress a decrease in the durability of the medium cartridge or medium processor side caused by impact and interference sustained during mounting, and the like.

DETAILED DESCRIPTION OF THE PREFERRED EMBODIMENTS

Figure 1:
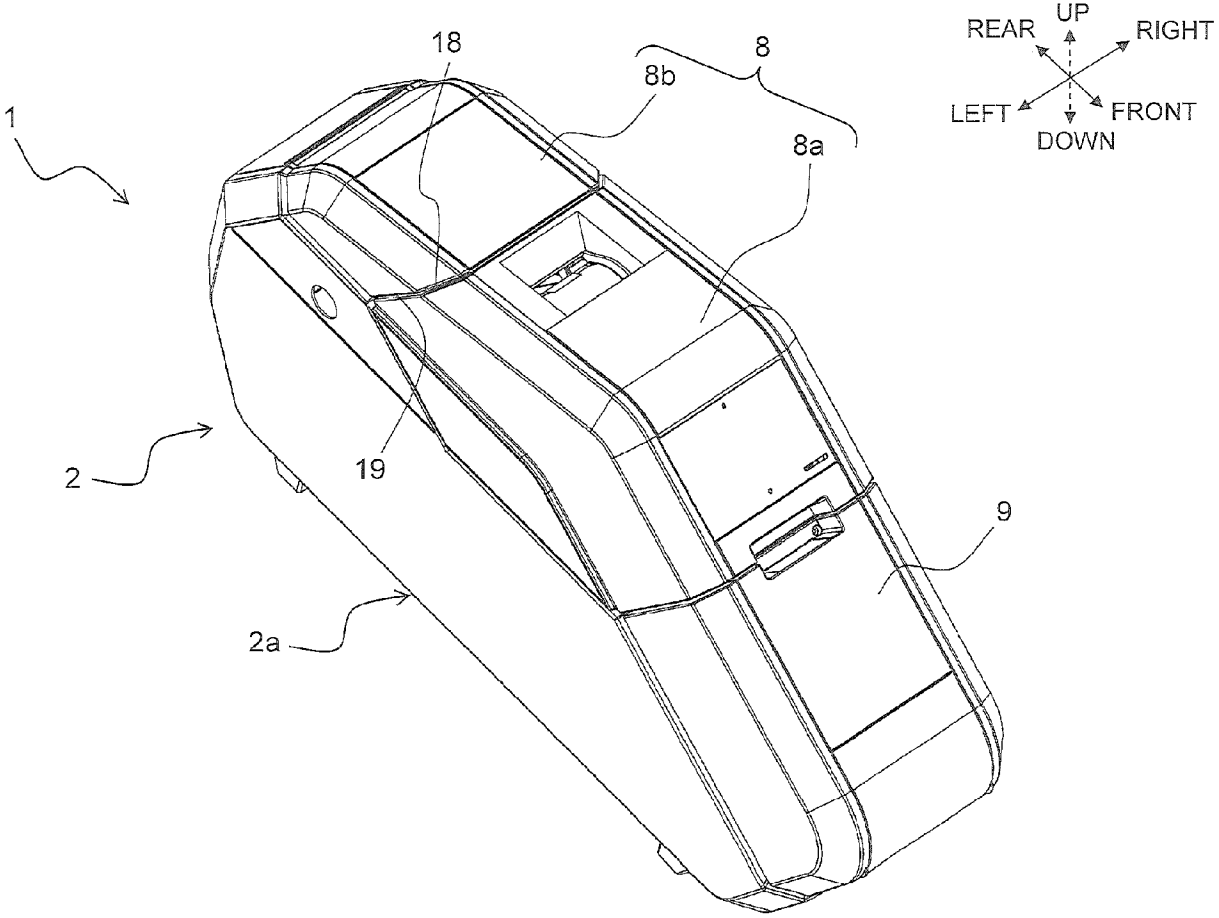
FIG. 1 is a perspective view showing the outer appearance of the tape printer related to an embodiment of the present disclosure.

The following describes one embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to this embodiment will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to the upper area of the rearward side of the housing main body 2*a* in an openable and closeable manner. This rearward-side opening/closing part 8 is capable of opening and closing the area above the first storage part 3 by pivoting. The rearward-side opening/closing part 8 comprises a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states in FIGS. 1 and 2) in which it covers the area above the frontward side of the first storage part 3, to an open position (the states in FIGS. 3 and 4) in which it exposes the area above the frontward side of the first storage part 3.

Figure 2:
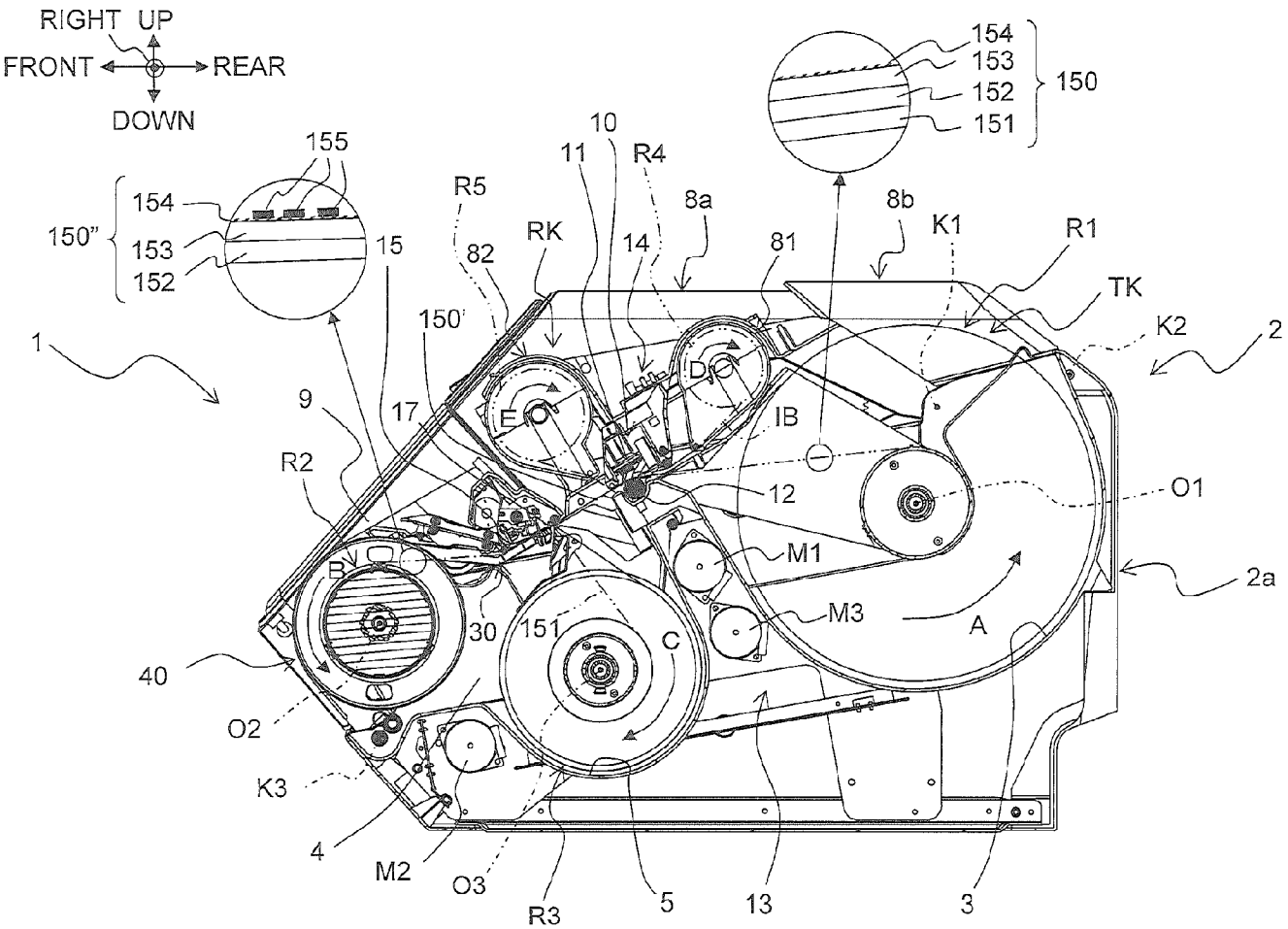
FIG. 2 is a side cross-sectional view showing the internal structure of the tape printer.
Figure 3:
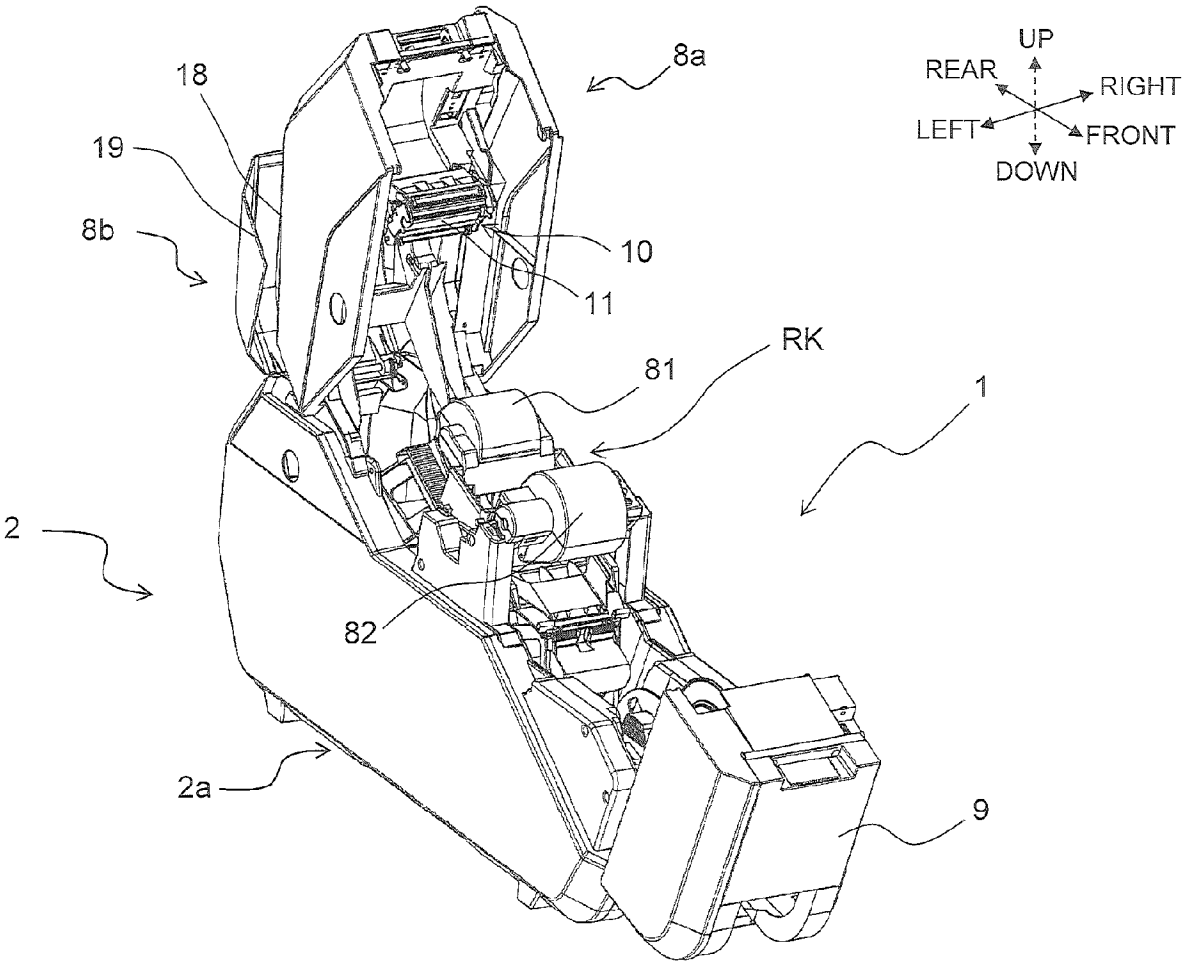
FIG. 3 is a perspective view showing the outer appearance of the tape printer with the first, second, and frontward-side opening/closing covers open.

A head holding body 10 is disposed in the interior of the first opening/closing cover 8*a* (refer to FIG. 3 as well). Then, the first opening/closing cover 8*a* pivots around the above described pivot axis K1, making it possible to move a print head 11 included in the head holding body 10 relatively closer to or farther away from a feeding roller 12 disposed on the housing main body 2*a*. Specifically, the first opening/closing cover 8*a* is capable of pivoting from a closed position (the states in FIGS. 1 and 2) in which the print head 11 is close to the feeding roller 12, to an open position (the states in FIGS. 3 and 4) in which the print head 11 is far away from the feeding roller 12.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states in FIGS. 1 and 2) in which it covers the area above the rearward side of the first storage part 3, to an open position (the states in FIGS. 3 and 4) in which it exposes the area above the rearward side of the first storage part 3.

Then, the first opening/closing cover 8*a* and the second opening/closing cover 8*b* are configured so that, when each is closed, an outer peripheral part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around the predetermined pivot axis K3 disposed on the upper end of the frontward side of the housing main body 2*a*. Specifically, the frontward-side opening/closing cover 9 is capable of pivoting from a closed position (the states in FIGS. 1 and 2) in which it covers the area above the third storage part 4, to an open position (the states in FIGS. 3 and 4) in which it exposes the area above the third storage part 4.

Print-Receiving Tape Roll and Surrounding Area Thereof

Figure 4:
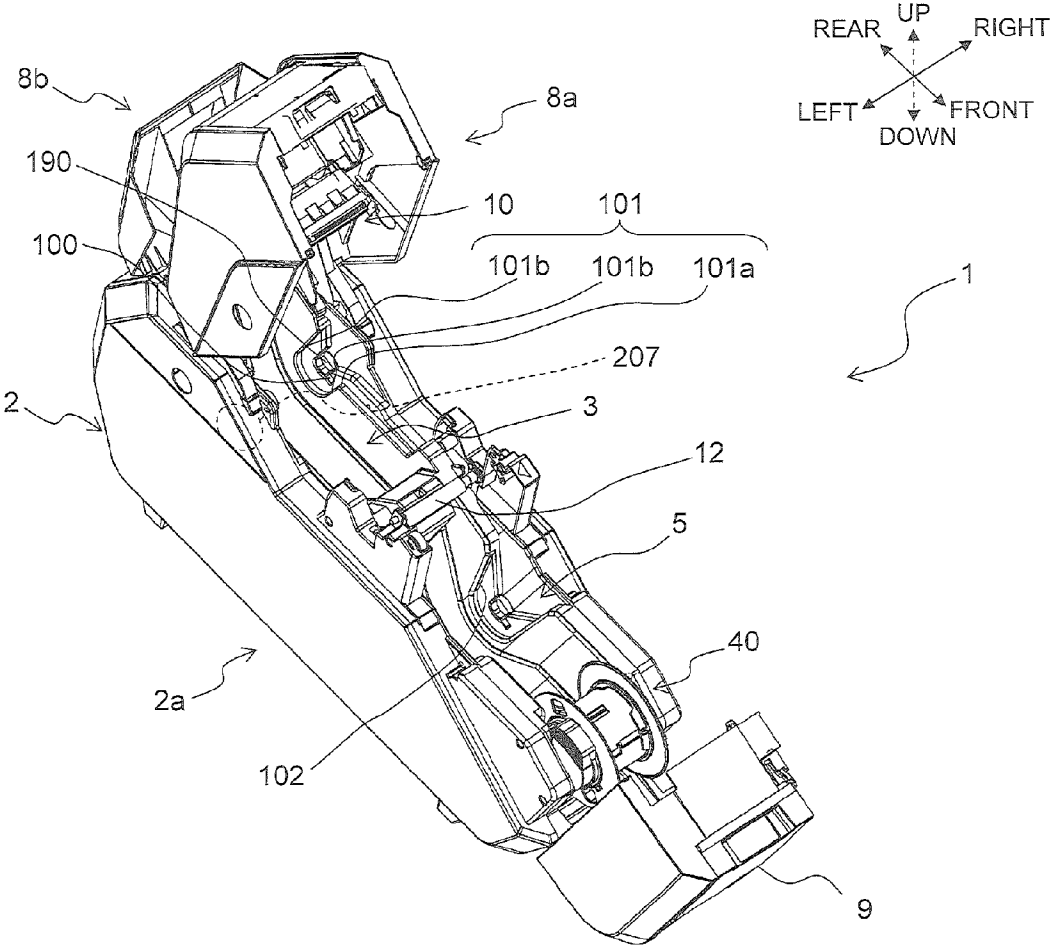
FIG. 4 is a perspective view showing the tape printer with the first, second, and frontward-side opening/closing covers open and the tape cartridge and ink ribbon cartridge removed.

At this time, as shown in FIGS. 2-4, a tape cartridge TK (refer to FIG. 2) is detachably mounted in a first predetermined position 13 below the frontward-side opening/closing cover 9 (when closed) in the housing main body 2*a*. This tape cartridge TK comprises a print-receiving tape roll R1 wound around and formed on an axis O1.

Figure 5:
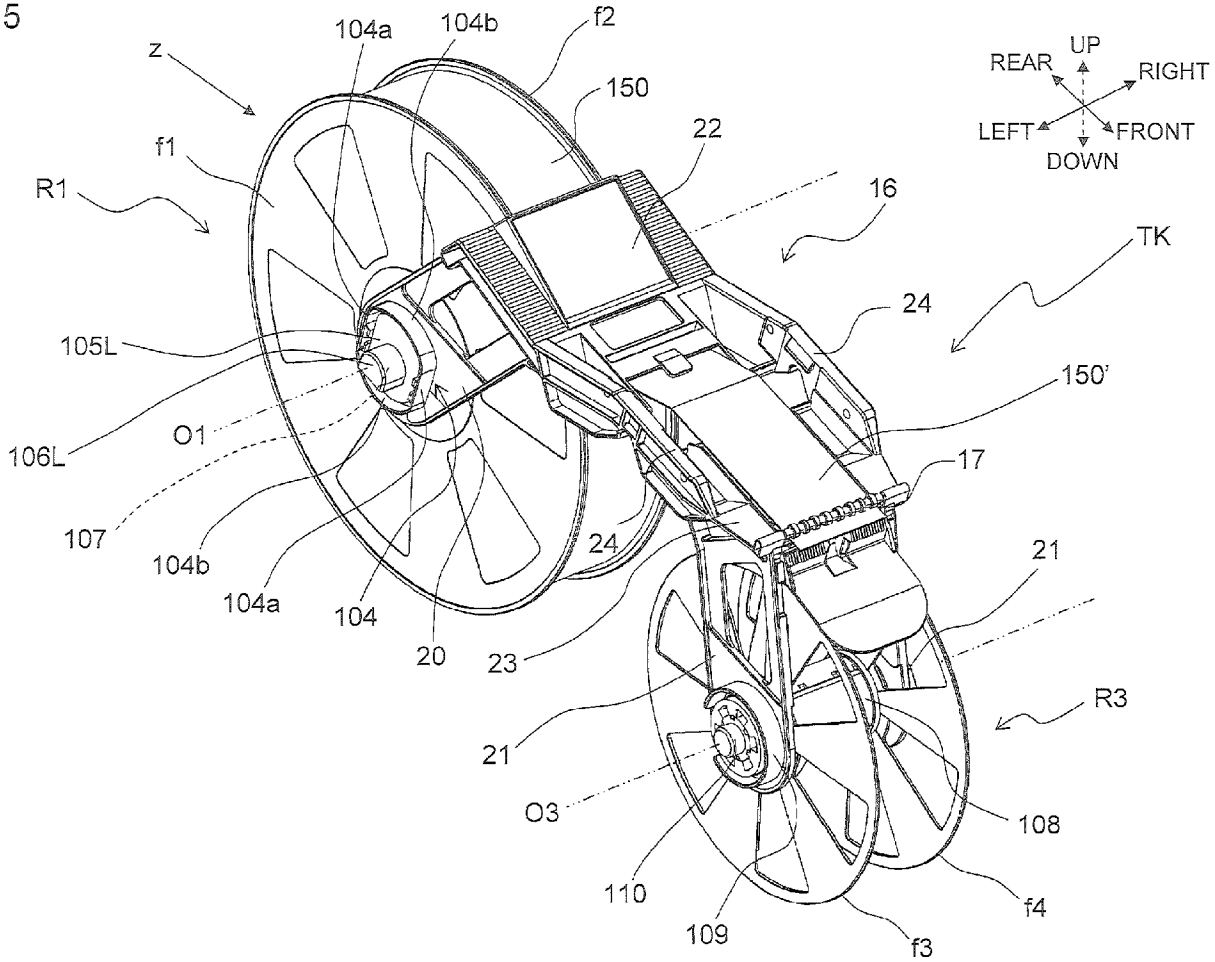
FIG. 5 is a perspective view showing the overall configuration of the tape cartridge.

That is, the tape cartridge TK comprises the print-receiving tape roll R1 and a connecting arm 16, as shown in FIG. 5. The connecting arm 16 comprises a left and right pair of first bracket parts 20, 20 disposed on the rearward side (in other words, one side along a line that connects the above described axis O1 and an axis O3 described later), and a left and right pair of second bracket parts 21, 21 disposed on the frontward side (in other words, the other side along the line that connects the above described axis O1 and the axis O3 described later).

The first bracket parts 20, 20 are set so as to sandwich the above described print-receiving tape roll R1 from both the left and right sides along the axis O1 via a left and right pair of substantially circular-shaped roll flange parts f1, f2, holding the print-receiving tape roll R1 rotatably around the axis O1 with the tape cartridge TK mounted to the housing main body 2*a* (the detailed holding structure will be described later).

These first bracket parts 20, 20 are connected by a first connecting part 22 that extends substantially along the left-right direction on the upper end, avoiding interference with the outer diameter of the print-receiving tape roll R1.

The print-receiving tape roll R1 is rotatable when the tape cartridge TK is mounted in the interior of the housing main body 2*a*. The print-receiving tape roll R1 winds a print-receiving tape 150 (comprising a print-receiving layer 154, a base layer 153, an adhesive layer 152, and a separation material layer 151 described later; refer to the enlarged view in FIG. 2) consumed by feed-out around the axis O1 in the left-right direction in advance.

The print-receiving tape roll R1 is received in the first storage part 3 from above by the mounting of the above described tape cartridge TK and stored with the axis O1 of the winding of the print-receiving tape 150 in the left-right direction. Then, the print-receiving tape roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 comprising adhesive is used. That is, the print-receiving tape 150 is layered in the order of the print-receiving layer 154, the base layer 153, the adhesive layer 152, and the separation material layer 151, from one side in the thickness direction (upward side in FIG. 2) toward the other side (downward side in FIG. 2). The print-receiving layer 154 is a layer in which a desired print part 155 (refer to the enlarged partial view in FIG. 2) is formed by the heat transfer of ink from the above described print head 11. The adhesive layer 152 is a layer for affixing the base layer 153 to a suitable adherent (not shown). The separation material layer 151 is a layer that covers the adhesive layer 152.

Feeding Roller and Print Head

Returning to FIGS. 2-4, the above described feeding roller 12 is disposed on a middle upward side of the first storage part 3 and the second storage part 5 of the housing main body 2*a*. The feeding roller 12 is driven by a feeding motor M1 disposed in the interior of the housing main body 2*a* via a gear mechanism (not shown), thereby feeding the print-receiving tape 150 fed out from the print-receiving tape roll R1 stored in the first storage part 3 in a tape posture in which the tape-width direction is in the left-right direction.

Further, the above described head holding part 10 disposed on the first opening/closing cover 8*a* comprises the above described print head 11. The print head 11, as described above, is capable of moving relatively closer to or farther away from the feeding roller 12 by the pivoting of the first opening/closing cover 8*a* around the pivot axis K1. That is, the print head 11 moves closer to the feeding roller 12 when the first opening/closing cover 8*a* is closed, and farther away from the feeding roller 12 when the first opening/closing cover 8*a* is opened. This print head 11 is disposed in a position that faces the area above the feeding roller 12 of the head holding part 10, with the first opening/closing cover 8*a* closed, sandwiching the print-receiving tape 150 fed by the feeding roller 12 in coordination with the feeding roller 12. Accordingly, when the first opening/closing cover 8*a* is closed, the print head 11 and the feeding roller 12 are disposed facing each other in the up-down direction. Then, the print head 11 forms desired print on the print-receiving layer 154 of the print-receiving tape 150 sandwiched between the print head 11 and the feeding roller 12 using an ink ribbon IB of an ink ribbon cartridge RK described later, thereby forming a tape 150' with print.

Ink Ribbon Cartridge

Figure 6:
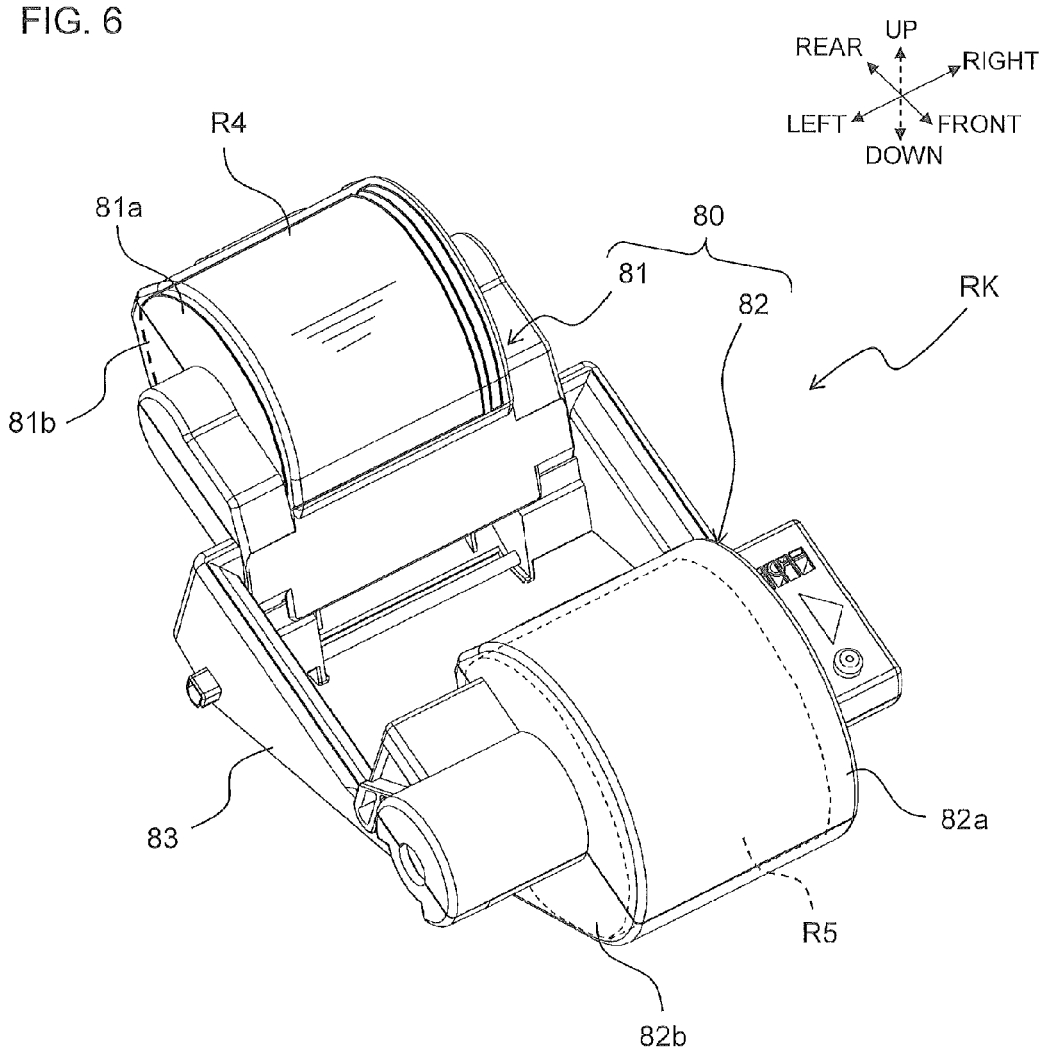
FIG. 6 is a perspective view showing the overall configuration of the ink ribbon cartridge from above.

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. FIG. 6 shows the detailed structure of the ink ribbon cartridge RK.

As shown in FIG. 6, the ink ribbon cartridge RK comprises a cartridge housing 80, a ribbon feed-out roll R4 around which is wound an unused ink ribbon IB in manner that enables feed-out, and a ribbon take-up roll R5. The cartridge housing 80 comprises a rearward-side feed-out roll storage part 81, a frontward-side take-up roll storage part 82, and a coupling part 83 that couples both of these storage parts 81, 82. The coupling part 83 couples the above described take-up roll storage part 82 and the above described feed-out roll storage part 81 while exposing the above described ink ribbon IB fed out from the ribbon feed-out roll R4 to the outside of the cartridge housing 80.

The feed-out roll storage part 81 is configured by combining a substantially semi-cylindrical upper part 81*a* and a lower part 81*b*. The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for performing print formation by the print head 11.

The take-up roll storage part 82 is configured by combining a substantially semi-cylindrical upper part 82*a* and a lower part 82*b*. The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print formation.

That is, in FIG. 2, the ink ribbon IB fed out from the ribbon feed-out roll R4 is disposed further on the print head 11 side of the print-receiving tape 150 sandwiched between the print head 11 and the feeding roller 12, contacting the area below the print head 11. Then, after the ink of the ink ribbon IB is transferred to the print-receiving layer 154 of the print-receiving tape 150 by the heat from the print head 11 to execute print formation, the used ink ribbon IB is taken up on the ribbon take-up roll R5.

Separation Material Roll and Surrounding Area Thereof

As shown in FIG. 5, the connecting arm 16 of the tape cartridge TK comprises a peeling part 17 that includes a substantially horizontal slit shape, for example. This peeling part 17 is an area that peels the separation material layer 151 from a tape 150' with print fed out from the print-receiving tape roll R1 and fed to the frontward side. As shown in FIG. 2, the above described peeling part 17 peels the above described separation material layer 151 from the tape 150' with print on which print was formed as described above, thereby separating the separation material layer 151 and the tape 150" with print made of the other layers, i.e., the print-receiving layer 154, the base layer 153, and the adhesive layer 152.

The tape cartridge TK, as shown in FIG. 2 and FIG. 5, comprises a separation material roll R3 formed by winding the above described peeled separation material layer 151 around an axis O3. That is, the separation material roll R3 is received in the above described second storage part 5 from above by the mounting of the aforementioned tape cartridge TK and stored with the axis O3 for winding the separation material layer in the left-right direction. Then, the separation material roll R3, stored in the second storage part 5 (with the tape cartridge TK mounted), is driven by a separation sheet take-up motor M3 that is disposed on an interior substrate 2*b* of the housing main body 2*a* via a gear mechanism (not shown) and rotates in a predetermined rotating direction (a direction C in FIG. 2) inside the second storage part 5, thereby taking up the separation material layer 151.

At this time, as shown in FIG. 5, the above described second bracket parts 21, 21 of the tape cartridge TK are set so as to sandwich the above described separation material roll R3 from both the left and right sides along the axis O3 via a left and right pair of substantially circular-shaped roll flange parts f3, f4, holding the separation material roll R3 rotatably around the axis O3 with the tape cartridge TK mounted to the housing main body 2*a* (the details of the holding structure will be described later). These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are coupled by a left and right pair of roll coupling beam parts 24, 24.

Note that FIG. 5 shows the state before the separation material layer 151 is wound around the axis O3 and the separation material roll R3 is formed (in the case of the unused tape cartridge TK). That is, FIG. 5 shows the above described substantially circular-shaped roll flange parts f3, f4 disposed so as to sandwich both width-direction sides of the separation material layer 151, and conveniently denotes the location where the separation material roll R3 is formed using the reference number "R3."

Tape Roll with Print and Surrounding Area Thereof

On the other hand, as shown in FIG. 2 and FIG. 4, a take-up mechanism 40 for sequentially winding the above described tape 150" with print is received in the above described third storage part 4 from above. The take-up mechanism 40 is stored so that it is supported rotatably around an axis O2 with the axis O2 of the winding of the tape 150" with print in the left-right direction. Then, the take-up mechanism 40, stored in the third storage part 4, is driven by an adhesive take-up motor M2 that is disposed in the interior of the housing main body 2*a* via a gear mechanism (not shown) and rotates in a predetermined rotating direction (a direction B in FIG. 2) inside the third storage part 4, taking up and layering the tape 150" with print. With this arrangement, the tape 150" with print is sequentially wound around the outer peripheral side of the take-up mechanism 40, forming a tape roll R2 with print.

Cutter Mechanism 30

Further, as shown in FIG. 2, a cutter mechanism 30 is disposed on the downstream side of the print head 11 and the upstream side of the tape roll R2 with print, along the tape transport direction.

The cutter mechanism 30, while not shown in detail, comprises a movable blade and a carriage that supports the movable blade, and is capable of travelling in the tape-width direction (in other words, the left-right direction). Then, the carriage travels by the driving of a cutter motor (not shown) and the movable blade moves in the tape-width direction, cutting the above described tape 150" with print in the width direction.

Overview of the Operation of the Tape Printer

Next, an overview of the operation of the tape printer 1 with the above described configuration will be described.

That is, when the tape cartridge TK is mounted in the above described first predetermined position 13, the print-receiving tape roll R1 is stored in the first storage part 3 positioned on the rearward side of the housing main body 2*a*, and the axis O3 side that forms the separation material roll R3 is stored in the second storage part 5 positioned on the frontward side of the housing main body 2*a*. Further, the take-up mechanism 40 for forming the tape roll R2 with print is stored in the third storage part 4 positioned on the frontward side of the housing main body 2*a*.

At this time, when the feeding roller 12 is driven, the print-receiving tape 150 fed out by the rotation of the print-receiving tape roll R1 stored in the first storage part 3 is fed to the frontward side. Then, desired print is formed by the print head 11 on the print-receiving layer 154 of the print-receiving tape 150 thus fed, thereby forming the tape 150' with print. When the tape 150' with print on which print was formed is further fed to the frontward side and fed to the peeling part 17, the separation material layer 151 is peeled at the peeling part 17, forming the adhesive tape 150" with print. The peeled separation material layer 151 is fed to the downward side, introduced to the second storage part 5, and wound inside the second storage part 5, forming the separation material roll R3.

On the other hand, the adhesive tape 150" with print from which the separation material layer 151 was peeled is further fed to the frontward side, introduced to the third storage part 4, and wound around the outer peripheral side of the take-up mechanism 40 inside the third storage part 4, thereby forming the tape roll R2 with print. At this time, the cutter mechanism 30 disposed on the transport direction downstream side (that is, the frontward side) cuts the adhesive tape 150" with print. With this arrangement, the adhesive tape 150" with print wound around the tape roll R2 with print can be cut based on a timing desired by the user and the tape roll R2 with print can be removed from the third storage part 4 after cutting.

Note that, at this time, although not explained by illustration, a non-adhesive tape (one without the above described adhesive layer 152 and separation material layer 151) may be wound around the print-receiving tape roll R1. In this case as well, the print-receiving tape roll R1 around which is wound the non-adhesive tape is received in the first storage part 3 from above by the mounting of the tape cartridge TK and stored with the axis O1 of the winding of the non-adhesive tape in the left-right direction. Then, the print-receiving tape roll R1, stored in the first storage part 3 (with the tape cartridge TK mounted), rotates in a predetermined rotating direction (the direction A in FIG. 2) inside the first storage part 3, thereby feeding out the non-adhesive tape.

Further, at this time, a shoot 15 (refer to FIG. 2) for switching the feeding path of the above described non-adhesive tape (or the above described print-receiving tape 150) between a side toward the tape roll R2 with print and a side toward the discharging exit (not shown) may be disposed. That is, the non-adhesive tape after print formation (or the tape 150" with print) may be discharged as is from the discharging exit (not shown) disposed on the second opening/closing cover 8*b* side, for example, of the housing 2 to the outside of the housing 2 without being wound inside the third storage part 4 as described later by switching the tape path by a switch operation of the shoot 15 using a switch lever (not shown).

Detailed Structure of Area Near Roll Axis

One of the special characteristics of this embodiment lies in the detailed structure near the axes O1, O3 of the print-receiving tape roll R1 included in the above described tape cartridge TK and the separation material roll R3. In the following, details on the functions will be described in order.

Support Structure Details of Print-Receiving Tape Roll

Figure 7:
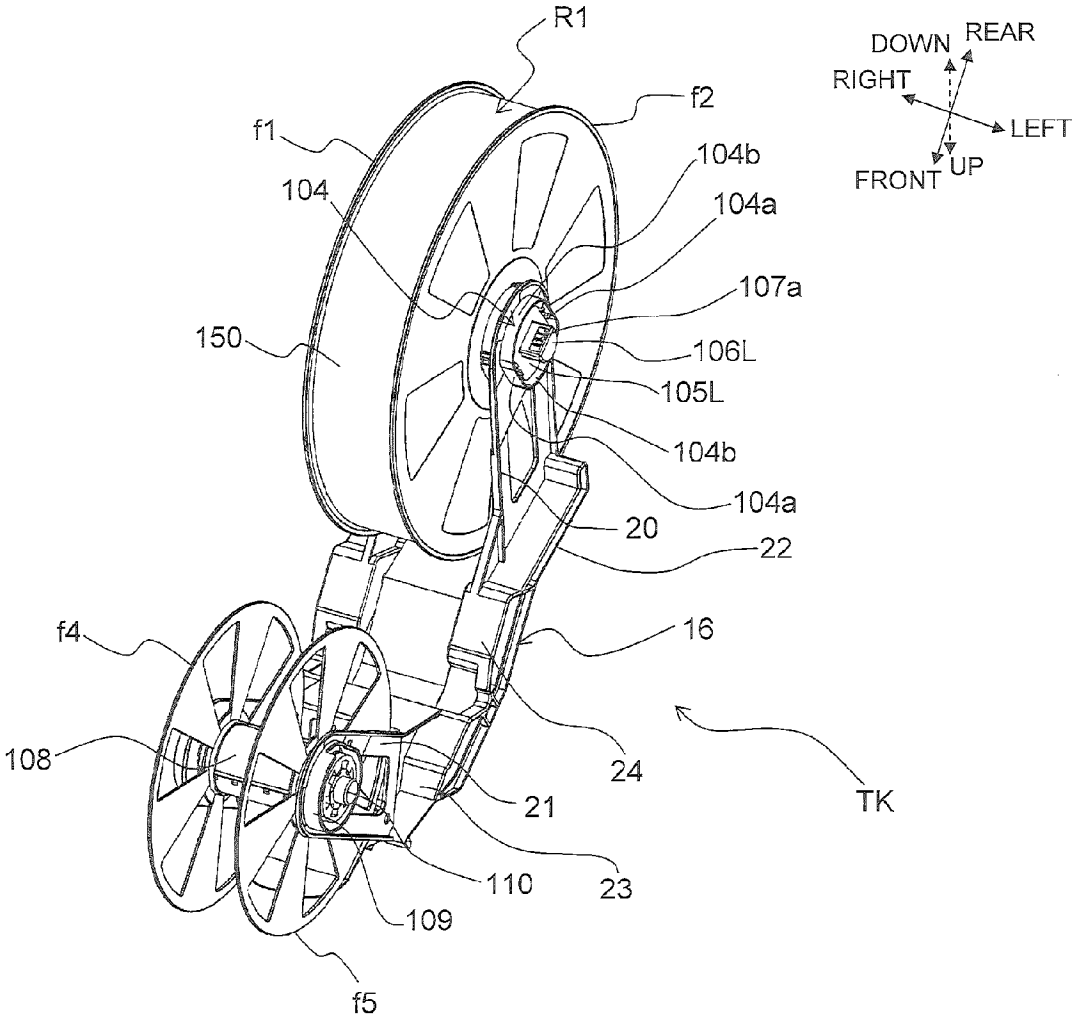
FIG. 7 is a perspective view showing the overall configuration of the tape cartridge from below.
Figure 8:
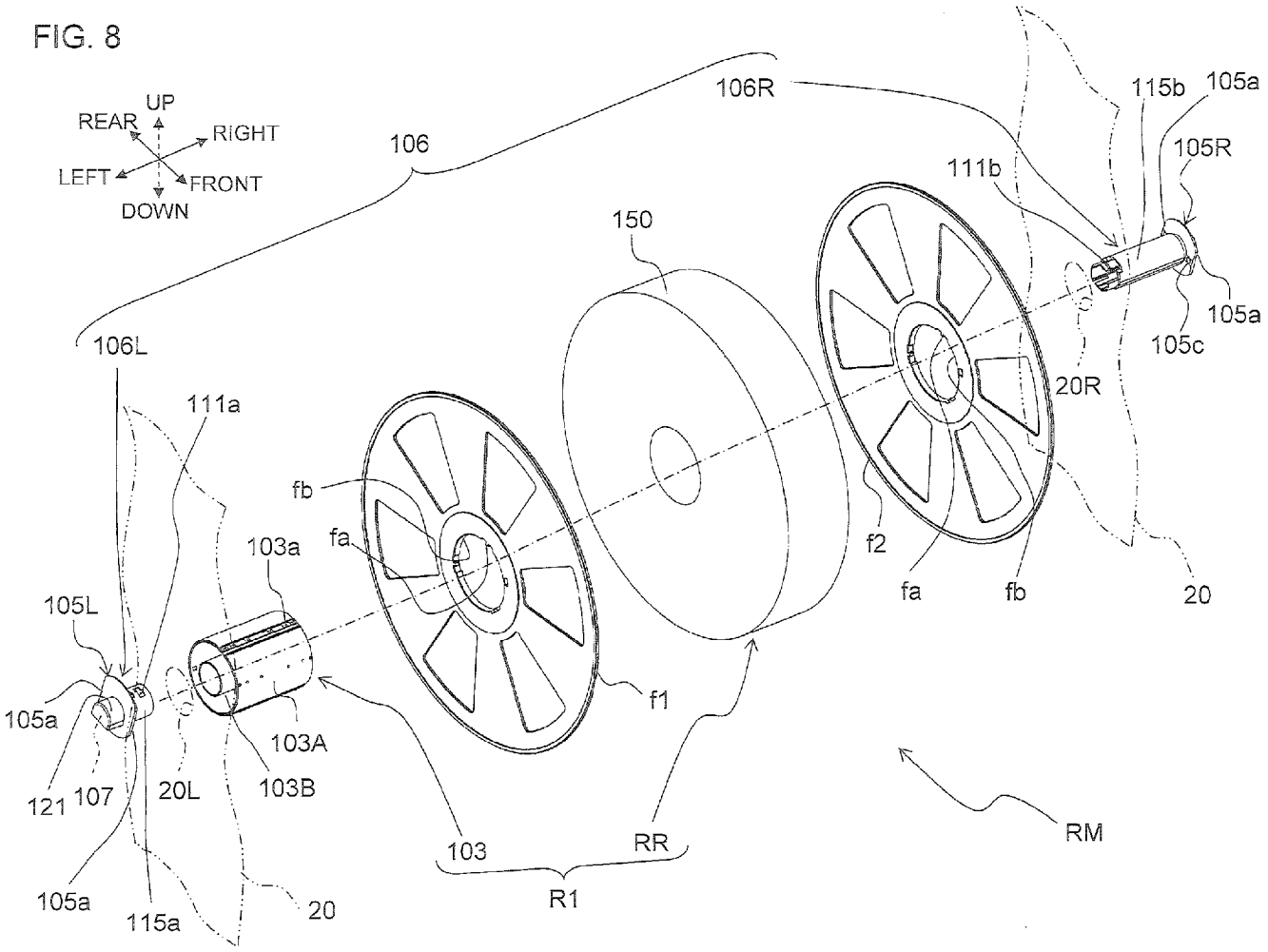
FIG. 8 is an exploded perspective view showing each component of the roll mechanism with a shaft incorporated in the tape cartridge.

As shown in the above described FIG. 5 and in FIG. 7 and FIG. 8, the print-receiving tape roll R1 comprises a roll core 103. That is, the above described print-receiving tape roll R1 is configured by winding the above described print-receiving tape 150 around the outer circumference of the roll core 103 in a manner that enables feed-out (by configuring a roll-shaped wound body RR).

The roll core 103 is rotatably supported by a fixed shaft member 106 wherein a left and right pair of a left fixed shaft part 106L and a right fixed shaft part 106R is directly connected to each other. That is, the roll core 103 comprises a double-tube structure with an outer cylinder 103A and an inner cylinder 103B. Then, a short cylinder part 115*a* positioned on the right-end side of the left fixed shaft part 106L is slidably inserted from the left side of the inner cylinder 103B. At this time, a through-hole 20L (roughly shown in FIG. 8) comprising an inner diameter that is larger than the outer diameter of the short cylinder part 115*a* is disposed on the above described first bracket part 20 on the left side. Then, the short cylinder part 115*a* is passed through the through-hole 20L and inserted into the inner cylinder 103B of the above described roll core 103 positioned on the opposite side (that is, the right side) via the first bracket part 20.

Similarly, a long cylinder part 115*b* positioned on the left-end side of the right fixed shaft part 106R is slidably inserted from the right side of the inner cylinder 103B. At this time, a through-hole 20R (roughly shown in FIG. 8) comprising an inner diameter that is larger than the outer diameter of the long cylinder part 115*b* is disposed on the above described first bracket part 20 on the right side. Then, the long cylinder part 115*b* is passed through the through-hole 20R and inserted into the inner cylinder 103B of the above described roll core 103 positioned on the opposite side (that is, the left side) via the first bracket part 20.

Subsequently, locking pieces 111*b* of the right fixed shaft part 106R are respectively engaged with locking holes 111*a* disposed in a plurality of circumferential-direction locations on the left fixed shaft part 106L, thereby coupling and integrating the left and right fixed shaft parts 106L, 106R. With this arrangement, the roll core 103 establishes the fixed shaft member 106 consisting of the left and right fixed shaft parts 106L, 106R as a fixed center axis and is slidably rotatable around that axis, between the left and right pair of first bracket parts 20, 20.

At this time, a plurality of locking holes 103*a* is formed on the surface of the outer cylinder 103A along the axial direction. On the other hand, a circular-shaped opening fb is disposed on the center side of the roll flange parts f1, f2. A locking protrusion fa is formed on the inner circumferential edge of a circular-shaped opening part gb. Then, the respective locking protrusions fa of the roll flange parts f1, f2 are fit together with any of the locking holes 103*a* of the outer cylinder 103A, making it possible to fix the roll flange parts f1, f2 in positions corresponding to the width of the print-receiving tape 150 constituting the print-receiving tape roll R1 (refer to FIG. 15 described later as well).

As described above, the short cylinder part 115*a* and the long cylinder part 115*b* of the left and right fixed shaft parts 106L, 106R constituting the above described fixed shaft member 106 are inserted (via an allowance) into the above described through-holes 20L, 20R. Nevertheless, these left and right fixed shaft parts 106L, 106R are non-rotatably engaged with the first bracket parts 20, 20 by positioning flange parts 105L, 105R respectively included therein. That is, the respective first bracket parts 20 include two up and down arc parts 104*b*, 104*b* and two front and rear linear parts 104*a*, 104*a*, and comprise a first guide part 104 generally with a substantially oval (elliptical) shape near the lower end, as shown in FIG. 5 and FIG. 7. On the other hand, the above described positioning flange parts 105L, 105R generally comprise a substantially elliptical shape (slightly smaller than the first guide part 104) that includes two front and rear linear outer edge parts 105*a*, 105*a* formed along the up-down direction (in other words, the gravity load direction). Then, when the short cylinder part 115*a* is inserted into the through-hole 20L as described above, the positioning flange part 105L is stored in the above described first guide part 104 of the left first bracket part 20 while disposing the above described outer edge parts 105*a*, 105*a* substantially along the above described linear parts 104*a*, 104*a*. Similarly, when the long cylinder part 115*b* is inserted into the through-hole 20R, the positioning flange part 105R is stored in the above described first guide part 104 of the right first bracket part 20 while disposing the above described outer edge parts 105*a*, 105*a* substantially along the above described linear parts 104*a*, 104*a*. As a result, with the left and right positioning flange parts 105L, 105R stored in the first guide parts 104, 104, the left and right fixed shaft parts 106L, 106R are non-rotatably engaged with the left and right first bracket parts 20, 20. Note that, with such an engagement of the positioning flange parts 105L, 105R with the first guide parts 104, all components (the roll mechanism RM with a shaft consisting of the fixed shaft member 106, the print-receiving tape roll R1, and the left and right roll flange parts f1, f2) shown in FIG. 8 are positioned in the attaching direction (positioning details described later).

With the above configuration, the roll flange parts f1, f2 and the roll core 103 are integrated, making rotation possible with respect to the fixed shaft member 106 to which the first bracket parts 20 are locked, between the left and right pair of first bracket parts 20, 20. As a result, the print-receiving tape roll R1 is rotatably supported around the above described axis O1 with respect to the first bracket parts 20, 20, making it possible to feed out the print-receiving tape 150 by rotation.

Memory Built into Shaft End of Left Fixed Shaft Part

One special characteristic of this embodiment is that a memory 107 serving as a storage medium is disposed on the left fixed shaft part 106L constituting the above described fixed shaft member 106. In the following, details on the functions will be described in order.

As shown in FIGS. 9A-9D and the above described FIG. 8, FIG. 7, and the like, the above described left fixed shaft part 106L comprises a shaft end housing part 121 on the opposite side (that is, the left side) of the above described short cylinder part 115*a*, with the positioning flange part 105L sandwiched therebetween. The shaft end housing part 121 comprises an outer shape that is substantially laterally D-shaped as viewed from the axial direction. The above described memory 107 is built inside this shaft end housing part 121.

Figure 9A:
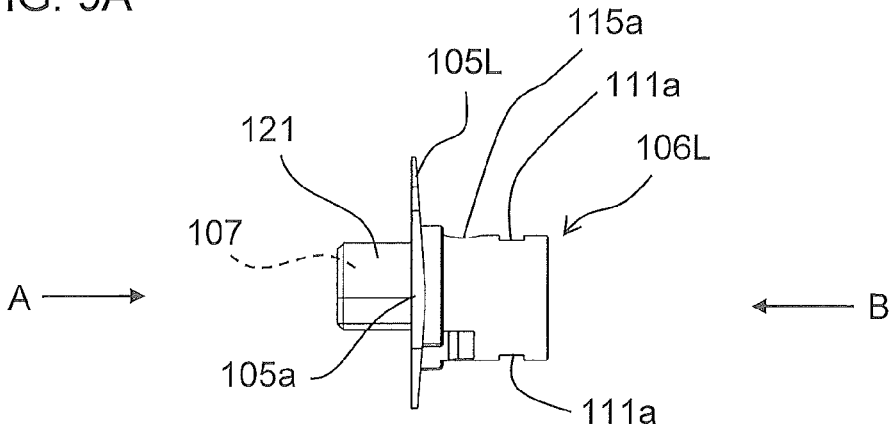
FIG. 9A is a side view showing the detailed structure of the left fixed shaft part.
Figure 9B:
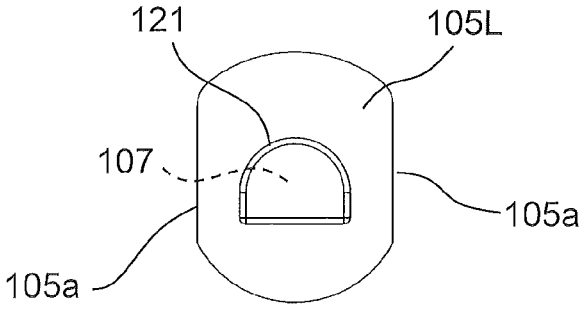
FIG. 9B is an arrow view from direction A in FIG. 9A.
Figure 9C:
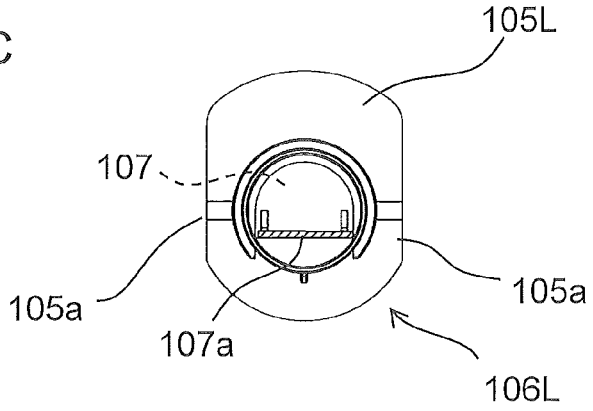
FIG. 9C is an arrow view from direction B in FIG. 9A.
Figure 9D:
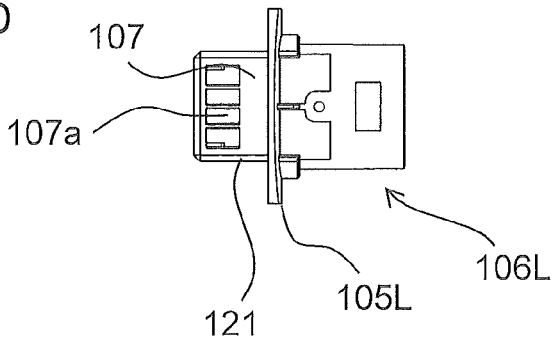
FIG. 9D is a bottom view showing the detailed structure of the left fixed shaft part.

Further, a terminal part 107*a* is disposed on the opening face disposed on the linear section below the above described D-shape of the shaft end housing part 121 (in other words, on the gravity load surface of the print-receiving tape roll R1 in the gravity load direction), exposing the surface (refer to FIG. 9D and FIG. 7).

The terminal part 107*a* conducts electricity to the above described memory 107. Then, when the tape cartridge TK is mounted inside the housing main body 2*a* as described later (in other words, when the first guide part 104 of the first bracket part 20 described later is inserted into a first lead-in groove 101 described later), the terminal part 107*a* contacts from above and conducts electricity to an external terminal 207 (only the position is conceptually shown in FIG. 4; refer to FIG. 14 described later as well) disposed in an inner circumferential side area (details described later) of the left-side wall surface of the housing main body 2*a*. With this arrangement, it is possible to read and write information from the housing 2 side with the above described memory 107 connected to this terminal part 107*a*.

Figure 10:
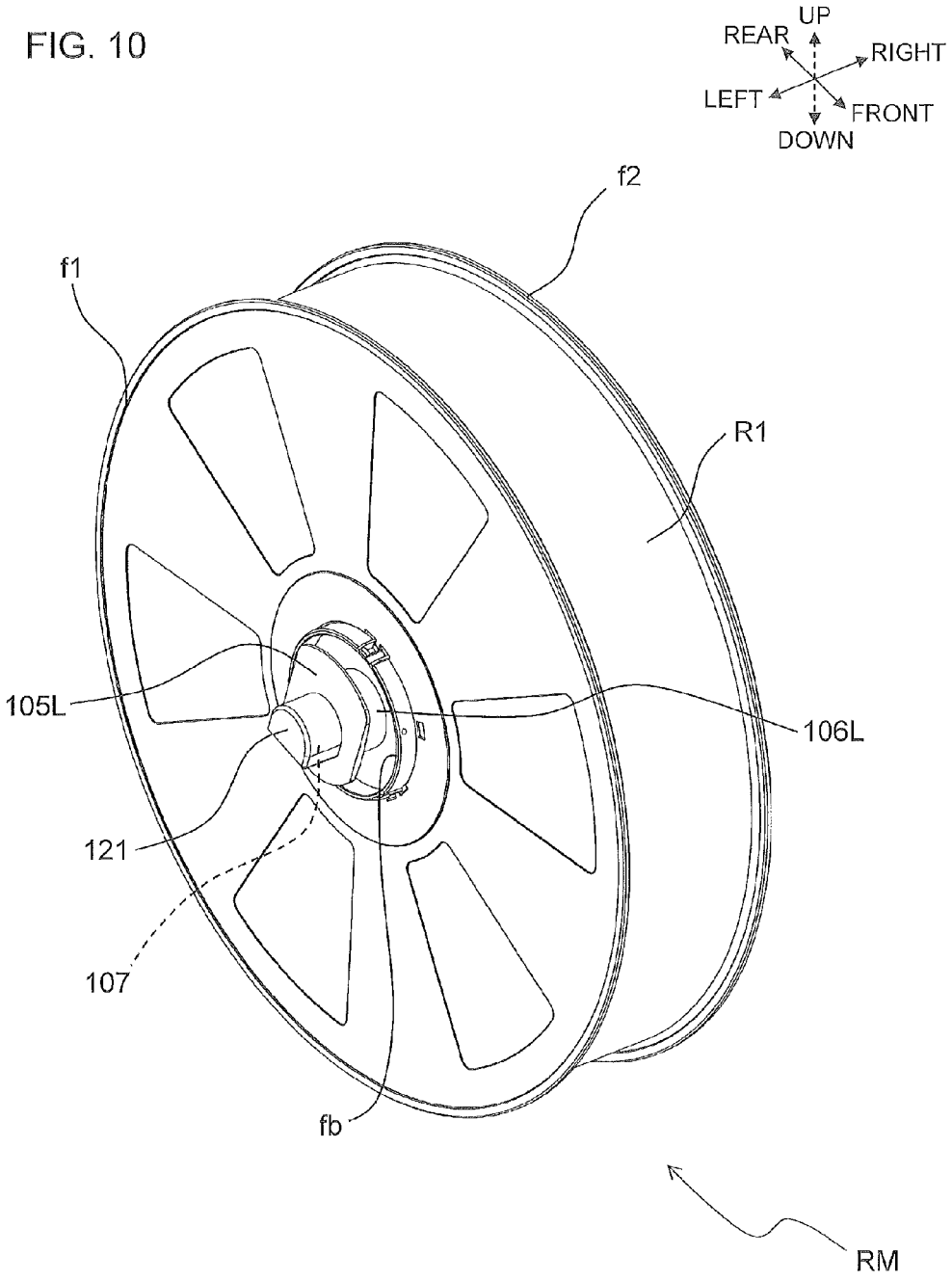
FIG. 10 is a perspective view showing a modification of the roll mechanism with a shaft.

Note that, while the above is an example wherein the memory 107 is disposed on the fixed shaft member 106 that rotatably supports the print-receiving tape roll R1 in the tape cartridge TK comprising the print-receiving tape roll R1 and the separation material roll R3, the present disclosure is not limited thereto. That is, the memory 107 may be disposed on the fixed shaft member 106 in the roll mechanism RM with a shaft wherein the roll flange parts f1, f2 and the print-receiving tape roll R1 configured around the roll core 103 (not shown) rotate with respect to the fixed shaft member 106, as shown in FIG. 10 (where the same reference numerals denote the same sections as described above). In this case, the overall roll mechanism RM with a shaft is attached and (removably, for example) fixed to a suitable fixation area by the left and right positioning flange parts 105L, 105R (not shown) of the fixed shaft member 106. Then, when the roll mechanism RM with a shaft is fixed, the above described terminal part 107*a* contacts and conducts electricity to the external terminal 207 disposed in the fixation area. With this arrangement, it is possible to read and write information from outside the roll mechanism RM with a shaft with the above described memory 107 connected to this terminal part 107*a*.

Detailed Structure Near Separation Material Roll Axis

Returning to FIG. 5 and FIG. 7, on the other hand, the separation material roll R3 also has a support structure similar to that of the above described print-receiving tape roll R1, though not shown in detail. That is, the separation material roll R3 comprises a roll core 108, and the separation material layer 151 peeled as described above is taken up and wound around the outer circumference of the roll core 108 (the roll-shaped wound body is configured), thereby constructing the above described separation material roll R3.

The roll core 108 is rotatably supported by the fixed shaft member 110. The roll core 108 is a double-tube structure with an outer cylinder and an inner cylinder, similar to the above described roll core 103. At this time, a through-hole (not shown) comprising an inner diameter that is larger than the outer diameter of the above described outer cylinder is disposed on each of the left and right above described second bracket parts 21, 21. Then, a shaft main body part (a section equivalent to the above described short cylinder part 115*a* and long cylinder part 115*b*; not shown) of the fixed shaft member 110 is passed through the through-hole and slidably inserted into the inner cylinder of the above described roll core 108. With this arrangement, the roll core 108 establishes the above described fixed shaft member 110 as the fixed center shaft and is slidably rotatable around that axis, between the left and right pair of second bracket parts 21, 21.

At this time, a plurality of locking holes is formed along the axial direction, similar to the locking holes 103*a* of the above described roll core 103, on the surface of the outer cylinder of the above described roll core 108. On the other hand, locking protrusions (not shown) similar to the locking protrusions fa of the above described roll flange parts f1, f2 are formed on the center side of the roll flange parts f3, f4. Then, the respective above described locking protrusions of the roll flange parts f3, f4 are fit together with any of the above described locking holes of the outer cylinder of the above described roll core 108, making it possible to fix the roll flange parts f3, f4 to positions corresponding to the width of the separation material 151 constituting the separation material roll R3 (in other words, the width of the print-receiving tape 150).

With the above configuration, the roll flange parts f3, f4 and the roll core 108 are integrated, making rotation possible with respect to the fixed shaft member 110, between the left and right pair of second bracket parts 21, 21. With this arrangement, the separation material roll R3 is rotatably supported around the above described axis O3 with respect to the second bracket parts 21, 21. At this time, the fixed shaft member 110 is operably connected to a separation sheet take-up motor M3 via a gear mechanism (not shown), and is rotated by the driving force from the separation sheet take-up motor M3, making it possible to take up the above described separation material layer 151 peeled from the above described print-receiving tape 150.

Guiding During Mounting by First and Second Guide Parts

Another special characteristic of this embodiment lies in the configuration that guides the mounting of the above described tape cartridge TK when the user mounts the tape cartridge TK inside the above described housing main body 2*a*, ensuring that the tape cartridge TK is mounted in the correct posture. In the following, details on the functions will be described in order.

First Guide Part and First Lead-in Groove

As described above, each of the first bracket parts 20 comprises the above described first guide part 104 near the lower end. The first guide part 104, as shown in FIG. 5 and FIG. 7, includes the two above described arc parts 104*b*, 104*b* that face each other, disposed on the top and bottom, and the two above described linear parts 104*a*, 104*a* that are parallel and in the substantially up-down direction, disposed on the front and rear, and generally comprises a substantially oval (elliptical) shape.

Then, correspondingly, as shown in FIG. 4, the first storage part 3 of the housing main body 2*a* comprises the substantially U-shaped first lead-in groove 101. The first lead-in groove 101 comprises an inlet part 101*a*, a substantially arc-shaped groove bottom part 101*c* positioned on the inner side of the groove, and parallel linear parts 101*b*, 101*b* disposed between the inlet part 101*a* and the groove bottom part 101*c*. The parallel linear parts 101*b*, 101*b* are configured by two parallel planes (two lines as viewed in the cross-section) respectively disposed on either side of the first lead-in groove 101 in the groove-width direction. Further, these parallel linear parts 101*b*, 101*b* comprise a function that permits entry of the above described first guide part 104 into the first lead-in groove 101 while restricting the entry direction (details described later). With this arrangement, storage of the print-receiving tape roll R1 into the first storage part 3 is guided by the first guide part 104 (details described later).

Second Guide Part and Second Lead-in Groove

On the other hand, each of the second bracket parts 21 comprises a substantially circular frame-shaped second guide part 109 near the lower end, as shown in FIG. 5 and FIG. 9. Then, correspondingly, as shown in FIG. 4, the second storage part 5 of the housing main body 2*a* comprises a second lead-in groove 102. The second lead-in groove 102 comprises an inlet part 102*a*, a substantially arc-shaped groove bottom part 102*c* positioned on the inner side of the groove, and side wall parts 102*b*, 102*b* disposed between the inlet part 102*a* and the groove bottom part 102*c*. The side wall parts 102*b*, 102*b* are configured by two inclined planes (a substantially reverse truncated chevron shape as viewed in the cross-section) respectively disposed on either side of the second lead-in groove 102 in the groove-width direction. The second lead-in groove 102 is capable of permitting entry of the above described second guide part 109 due to the above described shape. With this arrangement, storage of the separation material roll R3 into the second storage part 5 is guided by the second guide part 109 (details described later).

Details of Guide Function

Figure 11:
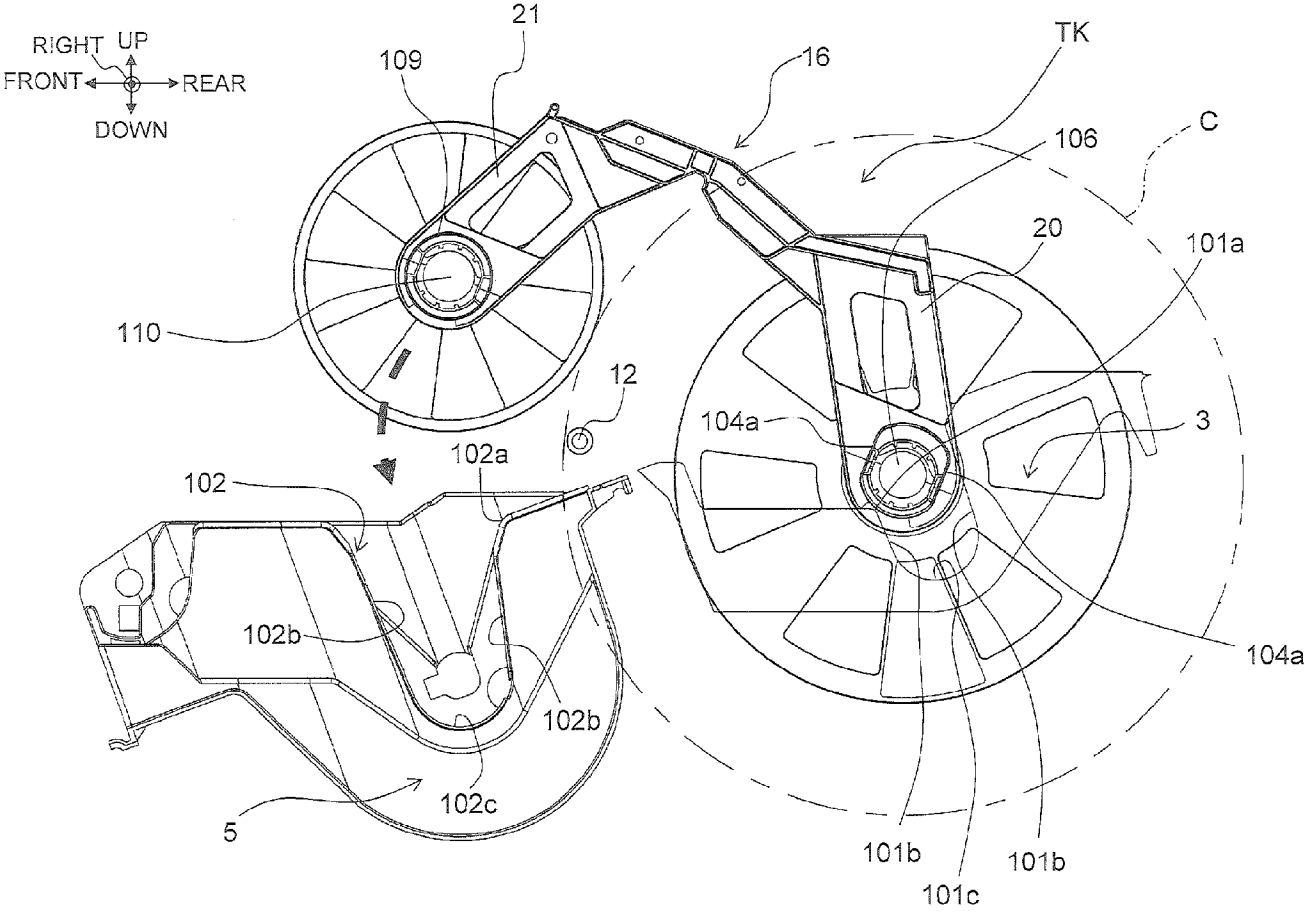
FIG. 11 is an explanatory view showing the entry restricted state of the tape cartridge in a partially transparent manner.

Next, the details of the guide function by the above described first guide part 104 and second guide part 109 during the mounting of the tape cartridge TK will be described using FIG. 11 and FIG. 12.

As described above, when the user mounts the tape cartridge TK, the above described print-receiving tape roll R1 is stored in the first storage part 3, and the separation material roll R3 is stored in the second storage part 5. At this time, normally the print-receiving tape roll R1 side is heavier than the separation material roll R3 side (in particular, the separation material roll R3 has not been formed if the print-receiving tape roll R1 has not been used), and therefore first the first guide part 104 enters the first lead-in groove 101. That is, as shown in FIG. 11, with the light separation material roll R3 side inclined slightly upward, first the first guide part 104 enters the first lead-in groove 101. At this time, during the period in which the long-axis direction of the first guide part 104 (that is, the direction of the above described linear parts 104*a*, 104*a*) does not match the direction of the parallel linear parts 101*b*, 101*b* of the above described substantially U-shaped first lead-in groove 101, entry is restricted with the first guide part 104 disposed on the above described inlet part 101*a* of the first lead-in groove 101, and the first guide part 104 is not permitted to enter the first lead-in groove 101 (the state in FIG. 11).

In this entry restricted state, the first guide part 104 is disposed on the inlet part 101*a* of the first lead-in groove 101, making it possible for the tape cartridge TK to assume various postures. In this case, as shown in FIG. 11, the outer shape of the separation material roll R3 generally draws an arc-shaped trajectory C centering in the vicinity of the inlet part 101*a* of the first lead-in groove 101, in association with the change in the posture of the tape cartridge TK.

Figure 12:
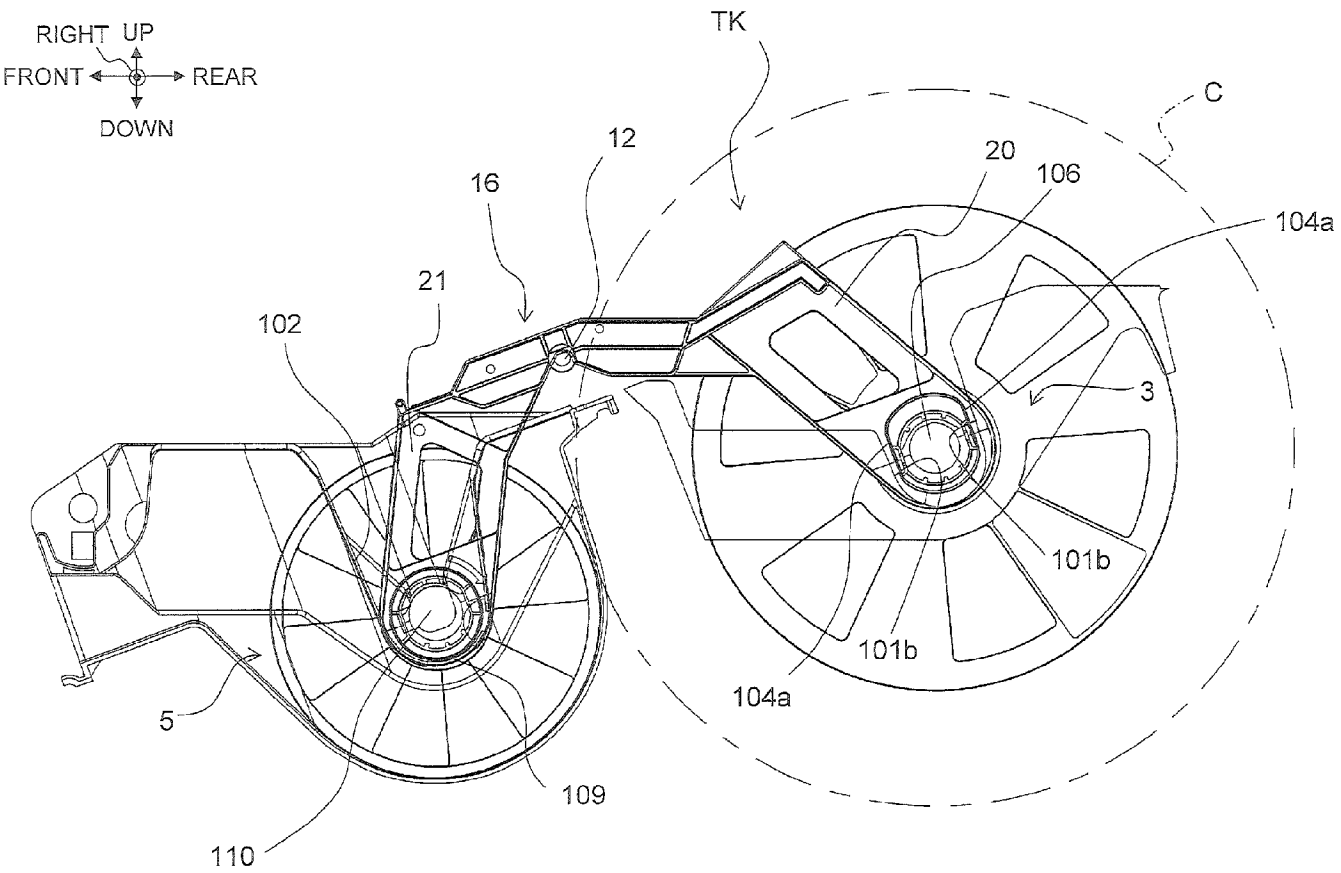
FIG. 12 is an explanatory view showing the entry permitted state of the tape cartridge in a partially transparent manner.

Then, after the separation material roll R3, which draws the trajectory C such as described above in association with this posture change of the tape cartridge TK, passes over and no longer interferes with the feeding roller 12, the state switches from the above described entry restricted state to an entry permitted state shown in FIG. 12. That is, in this entry permitted state, the long-axis direction of the first guide part 104 (that is, the direction of the above described linear parts 104*a*, 104*a*) matches the direction of the parallel linear parts 101*b*, 101*b* of the above described substantially U-shaped first lead-in groove 101. As a result, the first guide part 104 can be permitted to enter the first lead-in groove 101. Note that, after entry of the above described left and right first guide parts 104, 104 into the left and right first lead-in grooves 101, 101 is completed, the above described fixed shaft member 106 is inserted into and (removably) fixed to left and right support concave parts 190, 190 (only the right-side support concave part 190 is shown in FIG. 4) disposed in positions further outward to the left and right of the above described left and right first lead-in grooves 101, 101 of the housing main body 2*a*. As a result, the weight of the print-receiving tape roll R1 added to the fixed shaft member 106 is mainly supported by the left and right support concave parts 190, 190. Note that the aforementioned external terminal 207 is disposed in the above described left-side support concave part 190.

Note that, when the above described first guide part 104 enters the first lead-in groove 101, the second guide part 109 is guided by and enters the above described second lead-in groove 102. At this time, the above described second guide part 109 of the tape cartridge TK comprises a substantially circular shape, and the above described second lead-in groove 102 of the second storage part 5 comprises a substantially reverse truncated chevron shape. Accordingly, the above described second guide part 109 can be readily permitted to enter the second lead-in groove 102 (regardless of the posture of the tape cartridge TK).

Detection of Remaining Tape Amount of Print-Receiving Tape Roll by Encoder

Figure 13:
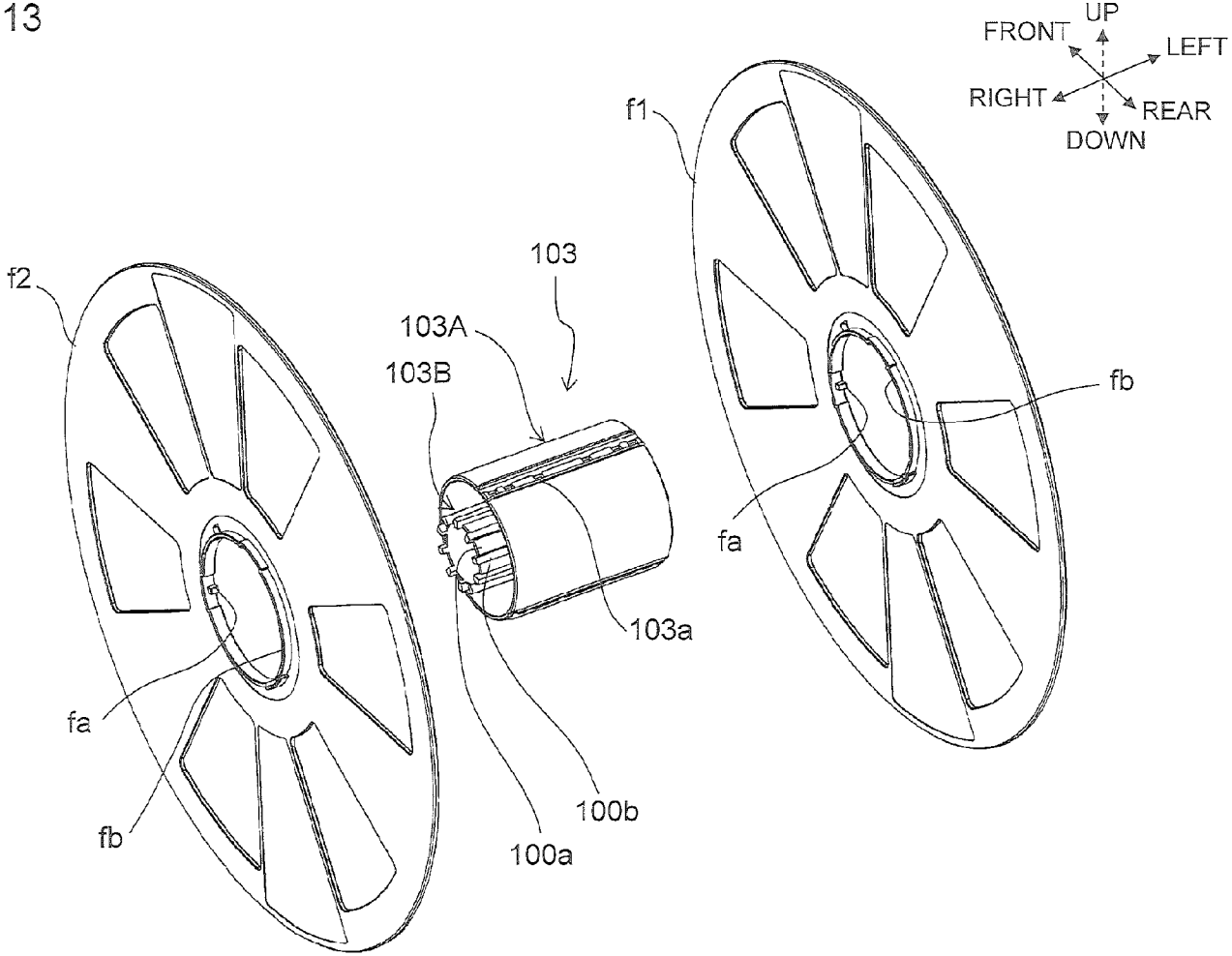
FIG. 13 is an exploded perspective view of the main part that constitute the print-receiving tape roll, showing the detected identifiers provided on the roll core.

Next, detection of the remaining amount of the print-receiving tape 150 of the print-receiving tape roll R1, which is yet another special characteristic of this embodiment, will be described using FIG. 13 and other figures. As shown in FIG. 13, a convex part 100*b* for detecting the remaining amount (in other words, the consumed amount) of the print-receiving tape 150 is formed at an equal interval along the circumferential direction on the outer peripheral surface of the above described inner cylinder 103B that constitutes the above described roll core 103. A concave part 100*a* is disposed between the respective detected convex parts 100*b*.

Note that, as described above, when the roll core 103 is slidably supported around the fixed shaft member 106 between the left and right pair of first bracket parts 20, 20, the right end of the above described outer cylinder 103A is not passed through the above described through-hole 20R of the right-side first bracket part 20, but the right end (including the above described convex part 100*b* and the concave part 100*a*) of the inner cylinder 103B is passed through the through-hole 20R and further exposed outward on the right side than the right-side first bracket part 20. As a result, the right-side first bracket part 20 covers the radial outer peripheral side of the above described convex part 100*b* and concave part 100*a*, and the above described positioning flange part 105R of the right fixed shaft part 106R covers one axial-direction side (the right side in this example) of the above described convex part 100*b* and concave part 100*a*.

At this time, as shown in the aforementioned FIG. 3, an encoder 100 that performs optical detection by a known technique is disposed on the right inner side wall of the first storage part 3 correspondingly to the above. This encoder 100 comprises an optical transmitter and an optical receiver, for example. When the tape cartridge TK is mounted as described above, the above described encoder 100 is positioned facing the aforementioned right-side positioning flange part 105R along the above described axis O1 direction. At this time, the convex part 100*b* and the concave part 100*a* of the above described roll core 103 are positioned on the opposite side (the left side) of the encoder 100 of this positioning flange part 105R. Then, a detection hole 105*c* for encoder detection is formed on the positioning flange part 105R (refer to FIG. 8). With this arrangement, the light from the above described optical transmitter can pass through the detection hole 105*c* and hit the convex part 100*b* or the concave part 100*a* along the above described axis O1 direction.

In a case where the above described convex part 100*b* is positioned on the light beam (parallel with the above described axis O1, for example) from the above described optical transmitter in accordance with the rotation of the inner cylinder 103B of the roll core 103, the light reflects on the convex part 100*b*, passes through the detection hole 105*c* once again in the opposite direction and is emitted, and is then received by the optical receiver. As a result, a predetermined detection signal corresponding to the above described light reception is output from the optical receiver. On the other hand, in a case where the above described concave part 100*a* is positioned on the light beam from the above described optical transmitter, light reception by the optical receiver such as described above does not occur (or the amount of received light is extremely small). As a result, a detection signal corresponding to the above described light reception is not output from the optical receiver. With the above, the above described concave part 100*a* and convex part 100*b* alternately arrive on the above described beam by the rotation of the roll core 103 (in other words, the rotation of the print-receiving tape roll R1), causing the ON/OFF state of the detection signal from the optical receiver to repeat according to a cycle corresponding to the above described rotation speed. With this arrangement, the rotation speed of the above described print-receiving tape roll R1 can be detected based on the length of the cycle.

Then, when the tape cartridge TK is used, the diameter of the print-receiving tape roll R1 decreases as the print-receiving tape 150 is fed out from the print-receiving tape roll R1 and consumed, causing the roll rotation speed, in other words, the rotation speed of the inner cylinder 103B of the roll core 103, to increase even if the tape feed-out speed is the same. With this arrangement, (though a detailed explanation is omitted since the technique is known,) the rotation speed of the roll core 103, that is, the print-receiving tape roll R1 is calculated based on the detection result of the encoder 100 as described above, making it possible to calculate the degree to which the diameter of the print-receiving tape roll R1 decreases, that is, the remaining tape amount, as described above.

Note that, as a result of the above, the concave part 100*a* and the convex part 100*b* are disposed on the right side of the roll core 103, which is the opposite side of the left fixed shaft part 106L of the fixed shaft member 106 where the above described memory 107 is disposed.

Control System

Next, the control system of the tape printer 1 will be described using FIG. 14. In FIG. 9, the tape printer 1 comprises a CPU 212 that constitutes a computing part that performs predetermined computations. The CPU 212 is connected to a RAM 213 and a ROM 214. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the above described tape roll R2 with print, a motor driving circuit 220 that controls the driving of the above described separation sheet take-up motor M3 that drives the above described separation material roll R3, a print head control circuit 221 that controls the conduction of the heating elements of the above described print head 11, a display part 215 that performs suitable displays, and an operation part 216 that permits suitable operation input by the user.

Further, according to this embodiment, the above described encoder 100 is connected to the CPU 212. With this arrangement, as described above, the detection signal from the optical receiver of the encoder 100 is input to the CPU 212, and the rotation speed of the above described roll core 103 is detected by the CPU 212 based on the ON/OFF cycle of the detection signal (in accordance with the rotation speed of the roll core 103).

Further, according to this embodiment, the above described external terminal 207 is connected to the CPU 212. With this arrangement, as described above, it is possible to read and write information with the above described memory 107 when the external terminal 207 contacts and conducts electricity to the terminal part 107*a*.

A control program for executing predetermined control processing is stored in the ROM 214. The RAM 213 comprises an image buffer 213*a* that expands print data of an image data format received from a PC (not shown), for example, into dot pattern data and stores the data for printing in a predetermined print area of the above described print-receiving layer 154. The CPU 212 performs printing corresponding to the print data by the print head 11 via the print head control circuit 221 in accordance with the print data stored in the image buffer 213*a* while the uneven tape 153 is fed out by the feeding roller 12, according to a suitable control program stored in the ROM 214.

Advantages of this Embodiment

As described above, in this embodiment, the roll core 103 that winds the print-receiving tape roll R1 is rotatably supported by the fixed shaft member 106. As a result, as described above, the gravity of the print-receiving tape roll R1, which is a rotating body, is mainly added to the above described fixed shaft member 106 (the left fixed shaft part 106L and the right fixed shaft part 106R) when the tape cartridge TK is mounted. Then, the aforementioned memory 107 is disposed on the terminal part 107*a* and the left fixed shaft part 106L. With this arrangement, the contact between the above described external terminal 207 and terminal part 107*a* can be more stably and reliably achieved compared to a case where the memory 107 and the terminal part 107*a* are disposed in another area where the gravity does not increase too much. With this arrangement, it is possible to execute the above described information reading or writing with the aforementioned memory 107 with high reliability.

Further, in particular, in this embodiment, the terminal part 107*a* is disposed on the gravity load surface of the print-receiving tape roll R1 of the shaft end housing part 121. With this arrangement, it is possible to reliably apply the gravity load to the terminal part 107*a*, making it possible to more reliably achieve contact between the external terminal 207 and the terminal part 107*a*.

Further, in particular, in this embodiment, the positioning flange parts 105L, 105R respectively comprise the linear-shaped outer edge parts 105*a*, 105*a* along the above described gravity load direction (up-down direction). With this arrangement, when the above described left fixed shaft part 106L is fixed to the above described support concave part 190, it is possible to position the overall roll mechanism RM with a shaft (refer to FIG. 8), including the print-receiving tape roll R1, in the attaching direction so that the gravity load is reliably applied along the direction in which the terminal part 107*a* and the external terminal 207 make contact.

Further, in this embodiment, the first guide part 104 of the first bracket part 20 comprises a substantially oval (elliptical) shape having the two front and rear linear parts 104*a*, 104*a* in the substantially up-down direction. Further, the substantially U-shaped first lead-in groove 101 comprising the parallel linear parts 101*b*, 101*b* is disposed on the housing main body 2*a*. Then, when the user mounts the above described tape cartridge TK inside the above described housing main body 2*a*, the first guide part 104 is not permitted to enter the first lead-in groove 101 during the period that the direction of the above described linear parts 104*a*, 104*a* of the first guide part 104 does not match the direction of the parallel linear parts 101*b*, 101*b* of the above described substantially U-shaped first lead-in groove 101. Once the posture of the tape cartridge TK changes and the direction of the above described linear parts 104*a*, 104*a* matches the direction of the above described parallel linear parts 101*b*, 101*b*, the first guide part 104 is permitted to enter the first lead-in groove 101. With this arrangement, storage of the print-receiving tape roll R1 into the first storage part 3 and storage of the separation material roll R3 into the second storage part 5 are executable only when the tape cartridge TK changes to a certain predetermined posture. As a result, it is possible to prevent the user from mounting the tape cartridge TK to the tape printer 1 in an improper position, thereby making it possible to suppress a decrease in the durability of the tape cartridge TK or tape printer 1 side caused by impact and interference sustained during mounting, and the like.

Further, in this embodiment, in order to detect the remaining amount (in other words, the consumed amount) of the print-receiving tape 150, the above described convex part 100*b* and concave part 100*a* serving as detected identifiers subject to the above described optical detection are formed on the roll core 103 of the print-receiving tape roll R1 and not the roll main body (roll-shaped wound body RR) or the roll flange parts f1, f2, or the like, for example. This design has significance such as follows.

That is, a need to use a plurality of width dimension types of the above described print-receiving tape 150 may arise. According to this embodiment, the configuration is designed to support such a need. For example, in a case where the print-receiving tape 150 with a wide width is to be used, as shown in FIG. 15A, the above described respective locking protrusions fa of the roll flange parts f1, f2 may be respectively fit together with the positions of the locking holes 103*a* corresponding to the maximum width of the outer cylinder 103A to wind the print-receiving tape 150 between these roll flange parts f1, f2 and construct the print-receiving tape roll R1.

Figure 15B:
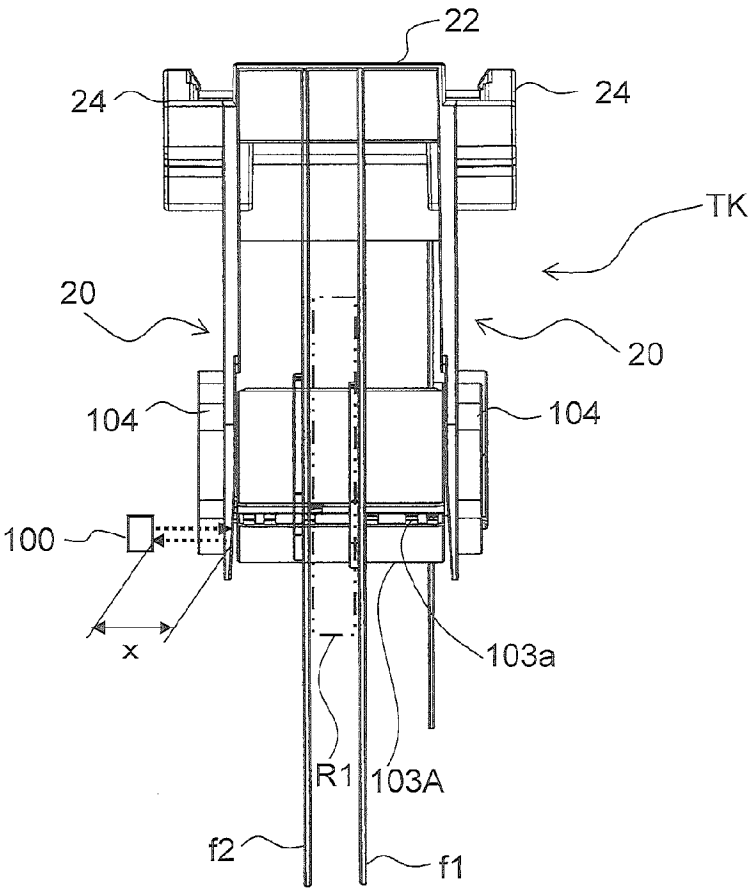
FIG. 15B is an arrow view of the tape cartridge from direction Z in FIG. 5.
Figure 15A:
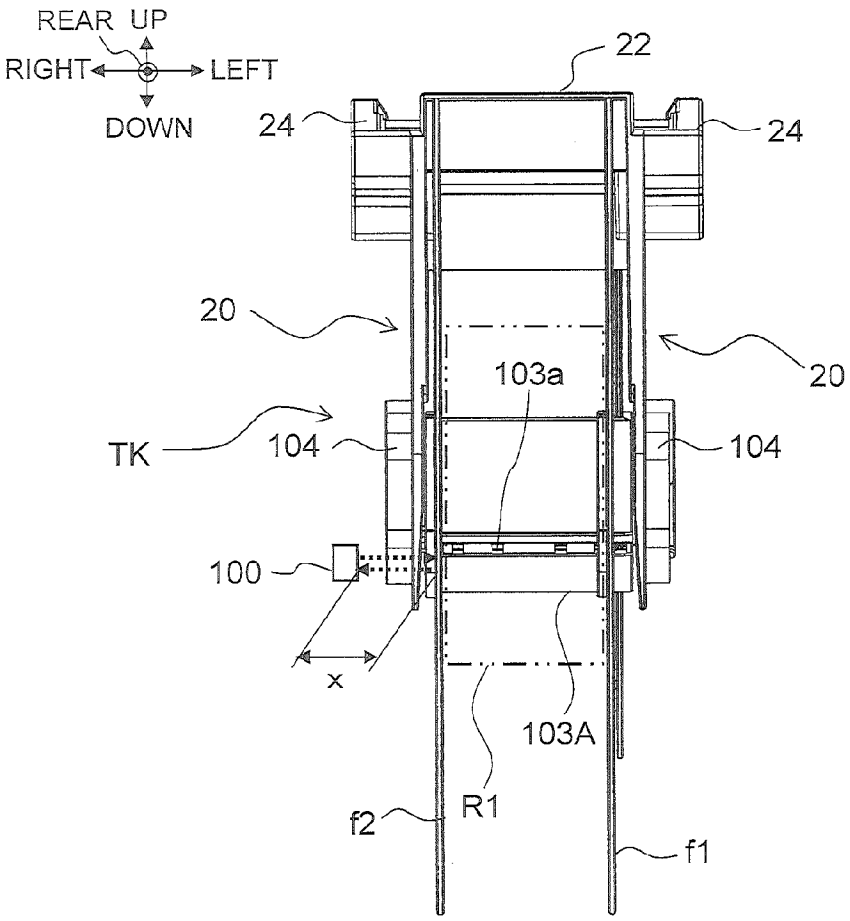
FIG. 15A is an arrow view of the tape cartridge from direction Z in FIG. 5.

Conversely, in a case where the print-receiving tape 150 with a narrow width is to be used, as shown in FIG. 15B, the above described respective locking protrusions fa of the roll flange parts f1, f2 may be respectively fit together with the positions of the locking holes 103*a* corresponding to the minimum width of the outer cylinder 103A to wind the print-receiving tape 150 between these roll flange parts f1, f2 and construct the print-receiving tape roll R1. By suitably selecting the attachment positions of the roll flange parts f1, f2 corresponding to the roll core 103 in accordance with the width of the print-receiving tape roll R1 in this manner, it is possible to respond to the above described need.

Hence, given a structure wherein detected identifiers are disposed on a roll main body, flange, or the like as described above, when the above described optical detection is performed by the encoder 100 from one axial-direction side (the rightward side in the aforementioned example) of the print-receiving tape roll R1, the distance from the encoder 100 to the detected identifiers changes according to whether the tape width of the above described print-receiving tape 150 is wide or narrow. As a result, the possibility exists that the detection accuracy will not be uniform and it will be difficult to maintain high detection accuracy.

Conversely, in this embodiment, the above described convex part 100*b* and concave part 100*a* serving as detected identifiers are disposed on the inner cylinder 103B of the roll core 103 as described above. With this arrangement, even in a case where a plurality of width types of tapes are used in the print-receiving tape roll R1, a distance x from the encoder 100 to the above described convex part 100*b* and concave part 100*a* of the above described roll core 103 can be made uniform (if the roll core 103 is made common to all rolls; refer to FIG. 15A and FIG. 15B). As a result, unlike the above, it is possible to make the detection accuracy uniform and thus stably detect the remaining amount of the print-receiving tape 150 with high accuracy.

Further, at this time, in this embodiment, as described above, the right-side first bracket part 20 covers the radial outer peripheral side of the above described convex part 100*b* and concave part 100*a*, and the above described positioning flange part 105R of the right fixed shaft part 106R covers the right side of the above described convex part 100*b* and concave part 100*a*. With this arrangement, it is possible to prevent the detection hole 105*c* of the positioning flange part 105R from becoming a hindrance to the above described optical detection as described above and prevent the above described convex part 100*b* and concave part 100*a* from becoming dusty and dirty. As a result, in this way as well, it is possible to increase the accuracy of the above described detection of the remaining amount.

Further, in particular, in this embodiment, the above described memory 107 is disposed on the fixed shaft member 106. With this arrangement, even if the tape cartridge TK is repeatedly mounted to and used in the above described tape printer 1, the tape cartridge TK itself can always hold the remaining tape amount information of the print-receiving tape roll R1 by the memory 107. As a result, it is possible to reliably acquire an accurate remaining tape amount of the print-receiving tape 150 by having the CPU 212 read the remaining tape amount information held by the memory 107 as described above. Further, the above described memory 107 is disposed on the left fixed shaft part 106L of the fixed shaft member 106, on the opposite side of the side where detection by the above described convex part 100*b* and concave part 100*a* is performed (the right side in this example). With this arrangement, in the tape printer 1, it is possible to divide the encoder 100 that detects the above described convex part 100*b* and concave part 100*a* and the above described external terminal 207 that performs information reading and writing with the above described memory 107 into the above described two sides without centralizing the two to one side, thereby making it possible to maintain freedom of layout.

Note that, while the above has described an illustrative scenario in which the present disclosure is applied to the tape printer 1 that performs printing on the print-receiving tape 150, the present disclosure is not limited thereto, allowing application to a tape processor that performs processing other than printing on a tape. In this case as well, the same advantages are achieved.

Figure 14:
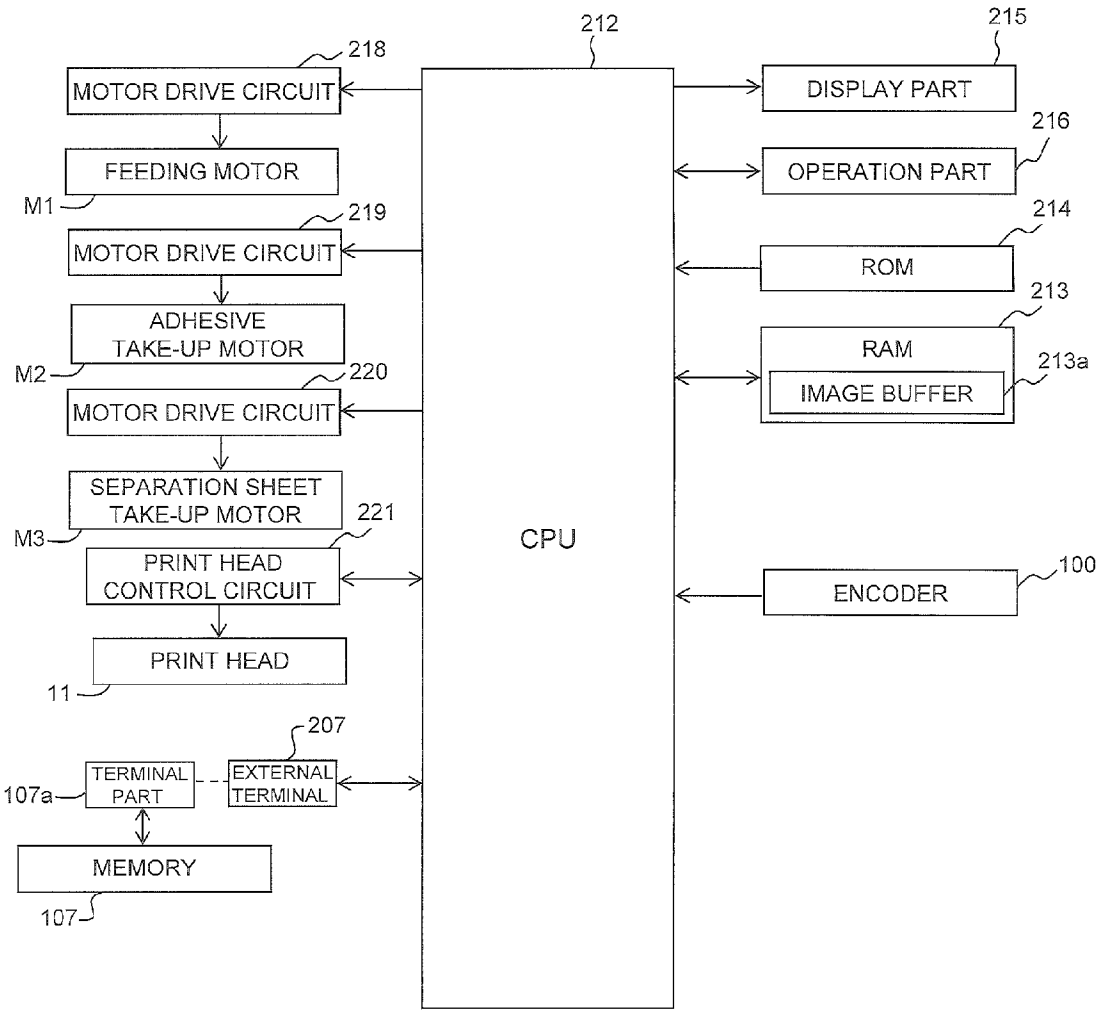
FIG. 14 is a function block diagram showing the configuration of the control system of the tape printer.

Note that, in the above, the arrows shown in the FIG. 14 denote an example of signal flow, but the signal flow direction is not limited thereto.

Further, other than that already stated above, techniques based on the above described embodiments and each of the modifications may be suitably utilized in combination as well.

What is claimed is:

1. A medium cartridge comprising:

a first record medium roll that winds a record medium wound around a first axis in a manner that enables feed-out and is configured to be stored in a first storage part of a medium processor;

a second record medium roll configured to take up and wind around a second axis at least a part of said record medium fed out from said first record medium roll, and to be stored in a second storage part of said medium processor and used; and a connecting arm that connects said first record medium roll and said second record medium roll, said connecting arm comprising:

a pair of first bracket parts that sandwich said first record medium roll from one side and the other side of the first record medium roll along said first axis to rotatably hold said first record medium roll, and are provided on one side of the medium cartridge along a line that connects said first axis and said second axis; and a pair of second bracket parts that sandwich said second record medium roll from one side and the other side of the second record medium roll along said second axis to rotatably hold said second record medium roll, and are provided on the other side of the medium cartridge along said line;

said first bracket parts comprising a substantially oval-shaped first guide part capable of entering a first lead-in groove provided in said first storage part; and said second bracket parts comprising a substantially circular-shaped second guide part capable of entering a second lead-in groove provided in said second storage part.

2. The medium cartridge according to claim 1, wherein:

said first guide part comprises two parallel linear parts respectively provided on said one side and said other side of the medium cartridge along said line.

3. The medium cartridge according to claim 1, wherein:

said first guide part comprises two arc parts that face each other and are respectively provided on one side and the other side of the medium cartridge in a direction orthogonal to said line.

4. A printer configured to mount a medium cartridge that holds on one side of a housing a first record medium roll that winds a first record medium in a manner that enables feed-out, and holds on the other side of the housing a second record medium roll capable of taking up and winding at least a part of said first record medium, and to perform print processing, comprising:

the housing;

a first storage part configured to store said first record medium roll of said medium cartridge, provided on said one side of said housing;

a second storage part configured to store said second record medium roll of said medium cartridge, provided on said other side of said housing;

a feeding roller configured to feed said first record medium fed out from said first record medium roll stored in said first storage part; and a print head configured to form desired printing on said first record medium fed by said feeding roller;

said first storage part comprising a substantially U-shaped first lead-in groove that comprises a parallel linear part configured to restrict a lead-in direction and permit entry of a substantially oval-shaped first guide part provided on said one side of said housing during storage of said first record medium roll; and said second storage part comprising a second lead-in groove configured to permit entry of a substantially circular-shaped second guide part provided on said other side of said housing during storage of said second record medium roll.

5. The printer according to claim 4, wherein:

said first lead-in groove comprises:

a first inlet part;

a substantially arc-shaped first groove bottom part positioned on an inner side of a groove; and said parallel linear parts consisting of two parallel lines respectively provided on both sides in a groove-width direction between said first inlet part and said first groove bottom part.

6. The printer according to claim 4, wherein:

said second lead-in groove comprises:

a second inlet part;

a substantially arc-shaped second groove bottom part positioned on an inner side of a groove; and side wall parts respectively provided on both sides in a groove-width direction in a substantially reverse truncated chevron shape between said second inlet part and said second groove bottom part.

7. The printer according to claim 4, wherein:

said first lead-in groove is configured so that:

in an entry restricted state where a long-axis direction of said substantially oval shape does not match a linear direction of said parallel linear part during storage of said first record medium roll, said first guide part is placed on said first inlet part of said first lead-in groove, and a posture of said medium cartridge is changeable; and said entry restricted state changes to an entry permitted state where said long-axis direction matches said linear direction after one side of an outer shape of said second record medium roll passes over said feeding roller in association with a change in said posture in said entry restricted state, wherein the entry permitted state permits entry of said first guide part from said first inlet part into said first lead-in groove.

8. The printer according to claim 4, further comprising:

a support concave part that removably fixes a fixed shaft member that rotatably supports a roll core of said first record medium roll.

9. The printer according to claim 8, wherein:

said support concave part comprises an external terminal configured to contact and conduct electricity to a terminal part provided on said fixed shaft member when said fixed shaft member is fixed.

* * * * *